US008979511B2

(12) United States Patent
Anex et al.

(10) Patent No.: US 8,979,511 B2
(45) Date of Patent: Mar. 17, 2015

(54) GEL COUPLING DIAPHRAGM FOR ELECTROKINETIC DELIVERY SYSTEMS

(75) Inventors: Deon S. Anex, Livermore, CA (US); Kenneth Kei-ho Nip, Redwood City, CA (US)

(73) Assignee: Eksigent Technologies, LLC, Dublin, CA (US)

( * ) Notice: Subject to any disclaimer, the term of this patent is extended or adjusted under 35 U.S.C. 154(b) by 191 days.

(21) Appl. No.: 13/465,939

(22) Filed: May 7, 2012

(65) Prior Publication Data

US 2012/0282113 A1 Nov. 8, 2012

Related U.S. Application Data

(60) Provisional application No. 61/482,889, filed on May 5, 2011, provisional application No. 61/482,918, filed on May 5, 2011.

(51) Int. Cl.
*F04B 17/00* (2006.01)
*F04B 43/06* (2006.01)
(Continued)

(52) U.S. Cl.
CPC ..... *F04B 19/006* (2013.01); *F04B 43/0054* (2013.01); *F04B 45/047* (2013.01); *F04B 43/043* (2013.01)
USPC ..... 417/413.2; 417/413.1; 417/53; 417/322; 92/96

(58) Field of Classification Search
CPC ..... F04B 9/10; F04B 9/103; F04B 9/105; F04B 13/00; F04B 17/00; F04B 35/008; F04B 43/00; F04B 43/0009; F04B 35/0054; F04B 43/0021; F04B 49/002; F04B 49/06; F04B 2203/0402; F04B 19/006; F04B 43/0054; F04B 43/009; F04B 43/025; F04B 45/043; F04B 45/047
USPC ..... 417/48, 52, 53, 322, 338, 339, 342, 417/413.2, 413.3, 379, 383, 390, 412, 417/413.1, 395; 92/96, 97
See application file for complete search history.

(56) References Cited

U.S. PATENT DOCUMENTS 1,063,204 A 6/1913 Kraft
2,615,940 A 10/1952 Williams
(Continued)

FOREIGN PATENT DOCUMENTS

CN 2286429 Y 7/1998
DE 1817719 A1 7/1970
(Continued)

OTHER PUBLICATIONS

Adamcyk et al., Characterization of Polyelectrolyte Multilayers by the Streaming Potential Method, Langmuir, vol. 20, 10517-10525, (Nov. 23, 2004).
(Continued)

*Primary Examiner* — Bryan Lettman
*Assistant Examiner* — Timothy P Solak
(74) *Attorney, Agent, or Firm* — Shay Glenn LLP

(57) ABSTRACT

A fluid delivery system includes a first chamber, a second chamber, and a third chamber, a pair of electrodes, a porous dielectric material, an electrokinetic fluid, and a flexible member including a gel between two diaphragms. The pair of electrodes is between the first chamber and the second chamber. The porous dielectric material is between the electrodes. The electrokinetic fluid is configured to flow through the porous dielectric material between the first and second chambers when a voltage is applied across the pair of electrodes. The flexible member fluidically separates the second chamber from the third chamber and is configured to deform into the third chamber when the electrokinetic fluid flows form the first chamber into the second chamber.

17 Claims, 14 Drawing Sheets

(51) Int. Cl.

| | |
|---|---|
| ***F04B 43/12*** | (2006.01) |
| ***F01B 19/00*** | (2006.01) |
| ***F04B 19/00*** | (2006.01) |
| ***F04B 43/00*** | (2006.01) |
| ***F04B 45/047*** | (2006.01) |
| ***F04B 43/04*** | (2006.01) |

(56) References Cited

U.S. PATENT DOCUMENTS

| | | | | |
|---|---|---|---|---|
| 2,644,900 | A | | 7/1953 | Hardway, Jr. |
| 2,644,902 | A | | 7/1953 | Hardway, Jr. |
| 2,661,430 | A | | 12/1953 | Hardway, Jr. |
| 2,841,324 | A | | 7/1958 | Santeler |
| 2,995,714 | A | | 8/1961 | Hannah |
| 3,143,691 | A | | 8/1964 | Hurd |
| 3,209,255 | A | | 9/1965 | Estes et al. |
| 3,298,789 | A | | 1/1967 | Mast |
| 3,427,978 | A | | 2/1969 | Hanneman et al. |
| 3,544,237 | A | | 12/1970 | Walz |
| 3,587,227 | A | | 6/1971 | Weingarten et al. |
| 3,598,506 | A | * | 8/1971 | O'Neill ..... 417/383 |
| 3,604,417 | A | | 9/1971 | Stolzenberg |
| 3,630,957 | A | | 12/1971 | Rey et al. |
| 3,666,379 | A | | 5/1972 | Mitchel et al. |
| 3,682,239 | A | | 8/1972 | Abu-Romia |
| 3,714,528 | A | | 1/1973 | Vail |
| 3,739,573 | A | | 6/1973 | Giner |
| 3,814,998 | A | * | 6/1974 | Thoma et al. ..... 361/283.4 |
| 3,923,426 | A | | 12/1975 | Theeuwes |
| 3,952,577 | A | | 4/1976 | Hayes et al. |
| 4,043,895 | A | | 8/1977 | Gritzner |
| 4,140,122 | A | | 2/1979 | Kuhl et al. |
| 4,208,031 | A | * | 6/1980 | Jonak ..... 251/61.2 |
| 4,209,014 | A | | 6/1980 | Sefton |
| 4,240,889 | A | | 12/1980 | Yoda et al. |
| 4,316,233 | A | | 2/1982 | Chato et al. |
| 4,383,265 | A | | 5/1983 | Kohashi |
| 4,396,382 | A | | 8/1983 | Goldhaber |
| 4,396,925 | A | | 8/1983 | Kohashi |
| 4,402,817 | A | | 9/1983 | Maget |
| 4,552,277 | A | | 11/1985 | Richardson et al. |
| 4,558,995 | A | * | 12/1985 | Furukawa et al. ..... 417/413.2 |
| 4,634,431 | A | | 1/1987 | Whitney et al. |
| 4,639,244 | A | | 1/1987 | Rizk et al. |
| 4,687,424 | A | | 8/1987 | Heimes |
| 4,704,324 | A | | 11/1987 | Davis et al. |
| 4,789,801 | A | | 12/1988 | Lee |
| 4,808,152 | A | | 2/1989 | Sibalis |
| 4,886,514 | A | | 12/1989 | Maget |
| 4,902,278 | A | | 2/1990 | Maget et al. |
| 4,908,112 | A | | 3/1990 | Pace |
| 4,921,041 | A | | 5/1990 | Akachi |
| 4,999,069 | A | | 3/1991 | Brackett et al. |
| 5,004,543 | A | | 4/1991 | Pluskal et al. |
| 5,037,457 | A | | 8/1991 | Goldsmith et al. |
| 5,062,770 | A | * | 11/1991 | Story et al. ..... 417/46 |
| 5,087,338 | A | | 2/1992 | Perry et al. |
| 5,116,471 | A | | 5/1992 | Chien et al. |
| 5,126,022 | A | | 6/1992 | Soane et al. |
| 5,137,633 | A | | 8/1992 | Wang |
| 5,219,020 | A | | 6/1993 | Akachi |
| 5,260,855 | A | | 11/1993 | Kaschmitter et al. |
| 5,279,608 | A | | 1/1994 | Cherif Cheikh |
| 5,288,214 | A | | 2/1994 | Fukuda et al. |
| 5,296,115 | A | | 3/1994 | Rocklin et al. |
| 5,312,389 | A | | 5/1994 | Theeuwes et al. |
| 5,351,164 | A | | 9/1994 | Grigortchak et al. |
| 5,418,079 | A | | 5/1995 | Diethelm |
| 5,523,177 | A | | 6/1996 | Kosek et al. |
| 5,531,575 | A | | 7/1996 | Lin |
| 5,534,328 | A | | 7/1996 | Ashmead et al. |
| 5,573,651 | A | | 11/1996 | Dasgupta et al. |
| 5,581,438 | A | | 12/1996 | Halliop |
| 5,628,890 | A | | 5/1997 | Carter et al. |
| 5,632,876 | A | | 5/1997 | Zanzucchi et al. |
| 5,658,355 | A | | 8/1997 | Cottevieille et al. |
| 5,683,443 | A | | 11/1997 | Munshi et al. |
| 5,766,435 | A | | 6/1998 | Liao et al. |
| 5,858,193 | A | | 1/1999 | Zanzucchi et al. |
| 5,862,035 | A | | 1/1999 | Farahmandi et al. |
| 5,888,390 | A | | 3/1999 | Craig |
| 5,891,097 | A | | 4/1999 | Saito et al. |
| 5,942,093 | A | | 8/1999 | Rakestraw et al. |
| 5,942,443 | A | | 8/1999 | Parce et al. |
| 5,958,203 | A | | 9/1999 | Parce et al. |
| RE36,350 | E | | 10/1999 | Swedberg et al. |
| 5,961,800 | A | | 10/1999 | McBride et al. |
| 5,964,997 | A | | 10/1999 | McBride |
| 5,989,402 | A | | 11/1999 | Chow et al. |
| 5,997,708 | A | | 12/1999 | Craig |
| 6,007,690 | A | | 12/1999 | Nelson et al. |
| 6,012,902 | A | | 1/2000 | Parce |
| 6,013,164 | A | | 1/2000 | Paul et al. |
| 6,019,745 | A | | 2/2000 | Gray |
| 6,019,882 | A | | 2/2000 | Paul et al. |
| 6,045,933 | A | | 4/2000 | Okamoto |
| 6,054,034 | A | | 4/2000 | Soane et al. |
| 6,068,752 | A | | 5/2000 | Dubrow et al. |
| 6,068,767 | A | | 5/2000 | Garguilo et al. |
| 6,074,725 | A | | 6/2000 | Kennedy |
| 6,086,243 | A | | 7/2000 | Paul et al. |
| 6,090,251 | A | | 7/2000 | Sundberg et al. |
| 6,100,107 | A | | 8/2000 | Lei et al. |
| 6,106,685 | A | | 8/2000 | McBride et al. |
| 6,113,766 | A | | 9/2000 | Steiner et al. |
| 6,126,723 | A | | 10/2000 | Drost et al. |
| 6,129,973 | A | | 10/2000 | Martin et al. |
| 6,137,501 | A | | 10/2000 | Wen et al. |
| 6,150,089 | A | | 11/2000 | Schwartz |
| 6,156,273 | A | | 12/2000 | Regnier et al. |
| 6,159,353 | A | | 12/2000 | West et al. |
| 6,176,962 | B1 | | 1/2001 | Soane et al. |
| 6,179,586 | B1 | | 1/2001 | Herb et al. |
| 6,210,986 | B1 | | 4/2001 | Arnold et al. |
| 6,224,728 | B1 | | 5/2001 | Oborny et al. |
| 6,255,551 | B1 | | 7/2001 | Shapiro et al. |
| 6,257,844 | B1 | | 7/2001 | Stern |
| 6,260,579 | B1 | | 7/2001 | Yokota et al. |
| 6,267,858 | B1 | | 7/2001 | Parce et al. |
| 6,277,257 | B1 | | 8/2001 | Paul et al. |
| 6,287,438 | B1 | | 9/2001 | Knoll |
| 6,287,440 | B1 | | 9/2001 | Arnold et al. |
| 6,290,909 | B1 | | 9/2001 | Paul et al. |
| 6,320,160 | B1 | | 11/2001 | Eidsnes et al. |
| 6,344,120 | B1 | | 2/2002 | Haswell et al. |
| 6,349,740 | B1 | | 2/2002 | Cho et al. |
| 6,379,402 | B1 | | 4/2002 | Suhara et al. |
| 6,406,605 | B1 | | 6/2002 | Moles |
| 6,409,698 | B1 | | 6/2002 | Robinson et al. |
| 6,418,966 | B2 | | 7/2002 | Loo |
| 6,418,968 | B1 | | 7/2002 | Pezzuto et al. |
| 6,444,150 | B1 | | 9/2002 | Arnold |
| 6,460,420 | B1 | | 10/2002 | Paul et al. |
| 6,464,474 | B2 | * | 10/2002 | Schluecker ..... 417/383 |
| 6,472,443 | B1 | | 10/2002 | Shepodd |
| 6,477,410 | B1 | | 11/2002 | Henley et al. |
| 6,495,015 | B1 | | 12/2002 | Schoeniger et al. |
| 6,529,377 | B1 | | 3/2003 | Nelson et al. |
| 6,561,208 | B1 | | 5/2003 | O'Connor et al. |
| 6,572,823 | B1 | | 6/2003 | Donahue et al. |
| 6,613,211 | B1 | | 9/2003 | McCormick et al. |
| 6,619,925 | B2 | | 9/2003 | Ohkawa |
| 6,655,923 | B1 | | 12/2003 | Lisec et al. |
| 6,685,442 | B2 | | 2/2004 | Chinn et al. |
| 6,689,373 | B2 | | 2/2004 | Johnson et al. |
| 6,695,825 | B2 | | 2/2004 | Castles |
| 6,719,535 | B2 | | 4/2004 | Rakestraw et al. |
| 6,729,352 | B2 | | 5/2004 | O'Connor et al. |
| 6,733,244 | B1 | | 5/2004 | Fritsch et al. |
| 6,770,182 | B1 | | 8/2004 | Griffiths et al. |
| 6,770,183 | B1 | | 8/2004 | Hencken et al. |
| 6,814,859 | B2 | | 11/2004 | Koehler et al. |
| 6,843,272 | B2 | | 1/2005 | Schoeniger et al. |

(56) References Cited

U.S. PATENT DOCUMENTS

| | | | |
|---|---|---|---|
| 6,872,292 | B2 | 3/2005 | Theeuwes et al. |
| 6,878,473 | B2 | 4/2005 | Yamauchi et al. |
| 6,881,312 | B2 | 4/2005 | Kopf-Sill et al. |
| 6,905,583 | B2 | 6/2005 | Wainright et al. |
| 6,942,018 | B2 | 9/2005 | Goodson et al. |
| 6,952,962 | B2 | 10/2005 | Hasselbrink et al. |
| 6,962,658 | B2 | 11/2005 | Neyer et al. |
| 6,994,151 | B2 | 2/2006 | Zhou et al. |
| 7,094,464 | B2 | 8/2006 | Mao et al. |
| 7,101,947 | B2 | 9/2006 | Schlenoff et al. |
| 7,147,955 | B2 | 12/2006 | Adams |
| 7,207,982 | B2 | 4/2007 | Dionne et al. |
| 7,217,351 | B2 | 5/2007 | Krumme |
| 7,231,839 | B2 | 6/2007 | Huber et al. |
| 7,235,164 | B2 | 6/2007 | Anex et al. |
| 7,258,777 | B2 | 8/2007 | Paul et al. |
| 7,267,753 | B2 | 9/2007 | Anex et al. |
| 7,364,647 | B2 | 4/2008 | Paul et al. |
| 7,371,229 | B2 | 5/2008 | Theeuwes et al. |
| 7,399,398 | B2 | 7/2008 | Rakestraw et al. |
| 7,429,317 | B2 | 9/2008 | Paul |
| 7,470,267 | B2 | 12/2008 | Joshi et al. |
| 7,517,440 | B2 | 4/2009 | Anex et al. |
| 7,521,140 | B2 | 4/2009 | Arnold et al. |
| 7,559,356 | B2 | 7/2009 | Paul et al. |
| 7,575,722 | B2 | 8/2009 | Arnold |
| 7,867,592 | B2 | 1/2011 | Nelson et al. |
| 7,875,159 | B2 | 1/2011 | Anex et al. |
| 7,898,742 | B2 | 3/2011 | Rodríguez Fernandez et al. |
| 7,981,098 | B2 | 7/2011 | Boehringer et al. |
| 8,152,477 | B2 | 4/2012 | Anex et al. |
| 8,192,604 | B2 | 6/2012 | Anex et al. |
| 8,251,672 | B2 | 8/2012 | Saleki et al. |
| 2001/0008212 | A1 | 7/2001 | Shepodd et al. |
| 2001/0052460 | A1 | 12/2001 | Chien et al. |
| 2002/0048425 | A1 | 4/2002 | McBride et al. |
| 2002/0056639 | A1 | 5/2002 | Lackritz et al. |
| 2002/0066639 | A1 | 6/2002 | Taylor et al. |
| 2002/0070116 | A1 | 6/2002 | Ohkawa |
| 2002/0076598 | A1 | 6/2002 | Bostaph et al. |
| 2002/0089807 | A1 | 7/2002 | Bluvstein et al. |
| 2002/0125134 | A1 | 9/2002 | Santiago et al. |
| 2002/0166592 | A1 | 11/2002 | Liu et al. |
| 2002/0187074 | A1 | 12/2002 | O'Connor et al. |
| 2002/0187197 | A1 | 12/2002 | Caruso et al. |
| 2002/0187557 | A1 | 12/2002 | Hobbs et al. |
| 2002/0189947 | A1 | 12/2002 | Paul et al. |
| 2002/0195344 | A1 | 12/2002 | Neyer et al. |
| 2003/0044669 | A1 | 3/2003 | Hidaka et al. |
| 2003/0052007 | A1 | 3/2003 | Paul et al. |
| 2003/0061687 | A1 | 4/2003 | Hansen et al. |
| 2003/0114837 | A1 | 6/2003 | Peterson et al. |
| 2003/0116738 | A1 | 6/2003 | O'Connor et al. |
| 2003/0138678 | A1 | 7/2003 | Preidel |
| 2003/0190514 | A1 | 10/2003 | Okada et al. |
| 2003/0198130 | A1 | 10/2003 | Karp et al. |
| 2003/0198576 | A1 | 10/2003 | Coyne et al. |
| 2003/0206806 | A1 | 11/2003 | Paul et al. |
| 2003/0215686 | A1 | 11/2003 | DeFilippis et al. |
| 2003/0226754 | A1 | 12/2003 | Le Febre |
| 2003/0232203 | A1 | 12/2003 | Mutlu et al. |
| 2004/0031756 | A1 | 2/2004 | Suzuki et al. |
| 2004/0070116 | A1 | 4/2004 | Kaiser et al. |
| 2004/0087033 | A1 | 5/2004 | Schembri |
| 2004/0101421 | A1 | 5/2004 | Kenny et al. |
| 2004/0106192 | A1 | 6/2004 | Jeon et al. |
| 2004/0107996 | A1 | 6/2004 | Crocker et al. |
| 2004/0115731 | A1 | 6/2004 | Hansen et al. |
| 2004/0118189 | A1 | 6/2004 | Karp et al. |
| 2004/0129568 | A1 | 7/2004 | Seul et al. |
| 2004/0163957 | A1 | 8/2004 | Neyer et al. |
| 2004/0238052 | A1 | 12/2004 | Karp et al. |
| 2004/0241004 | A1 | 12/2004 | Goodson et al. |
| 2004/0241006 | A1 | 12/2004 | Taboryski et al. |
| 2004/0247450 | A1 | 12/2004 | Kutchinsky et al. |
| 2004/0248167 | A1 | 12/2004 | Quake et al. |
| 2005/0014134 | A1 | 1/2005 | West et al. |
| 2005/0161326 | A1 | 7/2005 | Morita et al. |
| 2005/0166980 | A1 | 8/2005 | Unger et al. |
| 2005/0235733 | A1 | 10/2005 | Holst et al. |
| 2005/0252772 | A1 | 11/2005 | Paul et al. |
| 2006/0127238 | A1 | 6/2006 | Mosier et al. |
| 2006/0266650 | A1 | 11/2006 | Han et al. |
| 2007/0062250 | A1 | 3/2007 | Krulevitch et al. |
| 2007/0062251 | A1 | 3/2007 | Anex |
| 2007/0066939 | A1 | 3/2007 | Krulevitch et al. |
| 2007/0066940 | A1 | 3/2007 | Karunaratne et al. |
| 2007/0093752 | A1 | 4/2007 | Zhao et al. |
| 2007/0093753 | A1 | 4/2007 | Krulevitch et al. |
| 2007/0129792 | A1 | 6/2007 | Picart et al. |
| 2007/0148014 | A1 | 6/2007 | Anex et al. |
| 2007/0224055 | A1 | 9/2007 | Anex et al. |
| 2007/0243084 | A1* | 10/2007 | Vogeley ..... 417/413.2 |
| 2008/0033338 | A1 | 2/2008 | Smith |
| 2008/0152507 | A1 | 6/2008 | Bohm |
| 2008/0154187 | A1 | 6/2008 | Krulevitch et al. |
| 2008/0173545 | A1 | 7/2008 | Anex et al. |
| 2008/0243096 | A1 | 10/2008 | Svedman |
| 2008/0249469 | A1 | 10/2008 | Selvaganapathy et al. |
| 2009/0035152 | A1 | 2/2009 | Butterfield |
| 2009/0036867 | A1 | 2/2009 | Glejboel et al. |
| 2009/0308752 | A1 | 12/2009 | Evans et al. |
| 2009/0311116 | A1* | 12/2009 | Bai et al. ..... 417/413.2 |
| 2010/0096266 | A1 | 4/2010 | Kim et al. |
| 2010/0100063 | A1 | 4/2010 | Joshi et al. |
| 2010/0124678 | A1 | 5/2010 | Meschter et al. |
| 2010/0304192 | A1 | 12/2010 | Chan et al. |
| 2010/0304252 | A1 | 12/2010 | Chan et al. |
| 2010/0312202 | A1 | 12/2010 | Henley et al. |
| 2011/0031268 | A1 | 2/2011 | Anex et al. |
| 2011/0037325 | A1 | 2/2011 | Ciocanel et al. |
| 2011/0112492 | A1 | 5/2011 | Bharti et al. |
| 2012/0219430 | A1 | 8/2012 | Anex et al. |
| 2013/0156608 | A1 | 6/2013 | Anex et al. |
| 2013/0211318 | A1 | 8/2013 | Croizat et al. |
| 2014/0236109 | A1 | 8/2014 | Greener |

FOREIGN PATENT DOCUMENTS

| | | | |
|---|---|---|---|
| EP | 0178601 | A2 | 4/1986 |
| EP | 0421234 | A2 | 4/1991 |
| EP | 1063204 | A2 | 12/2000 |
| JP | H02-229531 | | 9/1990 |
| JP | 03-087659 | A | 4/1991 |
| JP | U04-034468 | | 3/1992 |
| JP | 07269971 | A | 10/1995 |
| JP | 09270265 | A | 10/1997 |
| JP | 02-265598 | | 9/2002 |
| RU | 2008147087 | | 6/2010 |
| SU | 619189 | A | 8/1978 |
| WO | WO 94/05354 | A1 | 3/1994 |
| WO | WO 96/39252 | A1 | 12/1996 |
| WO | WO 99/16162 | A1 | 4/1999 |
| WO | WO 00/04832 | A1 | 2/2000 |
| WO | WO 00/55502 | A1 | 9/2000 |
| WO | WO 00/79131 | A1 | 12/2000 |
| WO | WO 01/25138 | A1 | 4/2001 |
| WO | WO 02/068821 | A2 | 9/2002 |
| WO | WO 02/086332 | A1 | 10/2002 |
| WO | WO 2004/007348 | A1 | 1/2004 |
| WO | WO2006/068959 | A2 | 6/2006 |

OTHER PUBLICATIONS

Adamson et al., Physical Chemistry of Surfaces, pp. 185-187; John Wiley & Sons, Inc., NY; (Aug. 4, 1997).

Ananthakrishnan et al., Laminar Dispersion in capillaries; A.I. Ch.E. Journal, 11(6):1063-1072 (Nov. 1965).

Aris, R.; On the dispersion of a solute in a fluid flowing through a tube. Proceedings of the Royal Society of London; Series A, Mathematical and Physical Sciences; vol. 235, No. 1200; pp. 67-77; (Apr. 10, 1956).

Baquiran et al.; Lippincott's Cancer Chemotherapy Handbook; 2nd Ed; Lippincott; Philadelphia; (Jan. 1, 2001).

(56) References Cited

OTHER PUBLICATIONS

Becker et al; Polymer microfabrication methods for microfluidic analytical applications; Electrophoresis; vol. 21; pp. 12-26; (Jan. 2000).
Belfer et al.; Surface Modification of Commercial Polyamide Reverse Osmosis Membranes; J. Membrane Sci.; 139; pp. 175-181; (Feb. 18, 1998).
Bello et al; Electroosmosis of polymer solutions in fused silica capillaries; Electrophoresis; vol. 15; pp. 623-626; (May 1994).
Bengtson, Harlan; The Orifice, Flow Nozzle, and Venturi Meter for Pipe Flow Measurement; Bright Hub; Engineering; Civil Engineering; Hydraulics; Ed. & Publ. by Lamar Stonecypher; 4 pages; (Aug. 24, 2010).
Boerman et al.; Pretargeted radioimmunotherapy of cancer: progress step by step; J. Nucl. Med.; vol. 44; No. 3; pp. 400-411; (Mar. 2003).
Boger, D.; Demonstration of upper and lower Newtonian fluid behaviour in a pseudoplastic fluid; Nature; vol. 265; pp. 126-128 (Jan. 13, 1977).
Braun et al.; Small-angle neutron scattering and cyclic voltammetry study on electrochemically oxidized and reduced pyrolytic carbon; Electrochimica Acta; vol. 49; pp. 1105-1112; (month unavailable 2004).
Buchholz et al.; Microchannel DNA sequencing matrices with switchable viscosities; Electrophoresis; vol. 23; pp. 1398-1409; (May 2002).
Burgreen et al.; Electrokinetic flow in ultrafine capillary slits; The Journal of Physical Chemistry, 68(95): pp. 1084-1091 (May 1964).
Caruso et al.; Investigation of electrostatic interactions in polyelectrolyte multilayer fills: binding of anionic fluorescent probes to layers assemble onto colloids; Macromolecules; vol. 32(7); pp. 2317-2328 (month unavailable 1999).
Chaiyasut et al.; Estimation of the dissociation constants for functional groups on modified and unmodified gel supports from the relationship between electroosmotic flow velocity and pH; Electrophoresis; vol. 22(7); pp. 1267-1272; (Apr. 2001).
Chatwin et al.; The effect of aspect ratio on longitudinal diffusivity in rectangular channels; J. Fluid Mech.; vol. 120; pp. 347-358 (Jul. 1982).
Chu et al.; Physicians Cancer Chemotherapy Drug Manual 2002; Jones and Bartlett Publisher; Massachusetts; (Mar. 25, 2002).
Churchill et al.; Complex Variables and Applications; McGraw-Hill, Inc. New York; (month unavailable 1990).
Collins, Kim; Charge density-dependent strength of hydration and biological structure; Biophys. J.; vol. 72; pp. 65-76; (Jan. 1997).
Conway, B.E.; Electrochemical Capacitors Their Nature, Function, and Applications; Electrochemistry Encyclopedia. 2003. (Available at http://electrochem.cwru.edu/ed/encycl/art-c03-elchem-cap.htm. Accessed May 16, 2006).
Conway, B.E.; Electrochemical Supercapacitors Scientific Fundamentals and Technological Applications; Kluwer Academic/Plenum Publishers; pp. 12-13, pp. 104-105, and pp. 192-195; (month unavailable 1999).
Cooke Jr., Claude E.; Study of electrokinetic effects using sinusoidal pressure and voltage; The Journal of Chemical Physics; vol. 23; No. 12; pp. 2299-2300; (Dec. 1955).
Dasgupta et al.; Electroosmosis: a reliable fluid propulsion system for flow injection analysis; Anal. Chem.; vol. 66; No. 11; pp. 1792-1798; (Jun. 1, 1994).
Decher, Fuzzy Nanoassemblies: Toward Layers Polymeric Multicomposites; Science; vol. 277; pp. 1232-1237; (Aug. 29, 21997).
DeGennes; Scaling Concepts in Polymer Physics; Cornell U. Press; p. 223; (Nov. 30, 1979).
Doshi et al.; Three dimensional laminar dispersion in open and closed rectangular conduits; Chemical Engineering Science; vol. 33(7); pp. 795-804; (month unavailable 1978).
Drott et al.; Porous silicon as the carrier matrix in microstructured enzyme reactors yielding high enzyme activities; J. Micromech. Microeng; vol. 7(1); pp. 14-23 (Mar. 1997).
Gan et al.; Mechanism of porous core electroosmotic pump flow injection system and its application to determination of chromium(VI) in waste-water; Talanta; vol. 51(4); pp. 667-675 (Apr. 3, 2000).
Gennaro, A.R.; Remington: The Science and Practice of Pharmacy (20th ed.); Lippincott Williams & Wilkins. Philadelphia; (Dec. 2000).
Gleiter et al.; Nanocrystalline Materials: A Way to Solids with Tunable Electronic Structures and Properties?; Acta Mater; vol. 49(4); pp. 737-745; (Feb. 23, 2001).
Gongora-Rubio et al.; The utilization of low temperature co-fired ceramics (LTCC-ML) technology for meso-scale EMS, a simple thermistor based flow sensor; Sensors and Actuators; vol. 73; No. 3; pp. 215-221; (Mar. 30, 1999).
Goodman and Gilman's "The Pharmacological Basis of Therapeutics;" (10th Ed.); Hardman et al. (editors); (Aug. 13, 2001).
Greene, George et al., Deposition and Wetting Characteristics of Polyelectrolyte Multilayers on Plasma-Modified Porous Polyethylene, Langmuir, vol. 20, pp. 2739-2745, (Mar. 30, 2004).
Gritsch et al.; Impedance Spectroscopy of Porin and Gramicidin Pores Reconstituted into Supported Lipid Bilayers on Indium—Tin—Oxide Electrodes; Langmuir; 14(11); pp. 3118-3125; (month unavailable 1998).
Gurau et al.; On the mechanism of the hofmeister effect; J. Am. Chem. Soc.; vol. 126; pp. 10522-10523; (Sep. 1, 2004).
Haisma; Direct Bonding in Patent Literature; Philips. J. Res.; vol. 49; issues 1-2; pp. 165-170; (Jan. 1, 1995).
Hunter; Foundations of Colloid Science vol. II (Oxford Univ. Press, Oxford) pp. 994-1002; (Sep. 14, 1989).
Jackson, J. D.; Classical Electrodynamics 2nd Ed. John Wiley & Sons, Inc. New York. (Oct. 3, 1975).
Jacobasch et al.; Adsorption of ions onto polymer surfaces and its influence on zeta potential and adhesion phenomena, Colloid Polym Sci.; vol. 276(5): pp. 434-442 (May 1998).
Jarvis et al.; Fuel cell / electrochemical capacitor hybrid for intermittent high power applications; J. Power Sources; vol. 79(1); pp. 60-63; (May 1999).
Jenkins, Donald et al., Viscosity B-Coefficients of Ions in Solution, Chem. Rev.; vol. 95; No. 8; pp. 2695-2724; (Dec. 1995).
Jessensky et al.; Self-organized formation of hexagonal pore structures in anodic alumina; J. Electrochem. Soc.; vol. 145; (11); pp. 3735-3740 (Nov. 1998).
Jimbo et al.; Surface Characterization of Poly(acrylonitrite) Membranes: Graft-Polymerized with Ionic Monomers as Revealed by Zeta Potential Measurements; Macromolecules; vol. 31; No. 4; pp. 1277-84; (Jan. 13, 1998).
Johnson et al.; Dependence of the conductivity of a porous medium on electrolyte conductivity; Physical Review Letters; 37(7); pp. 3502-3510 (Mar. 1, 1988).
Johnson et al.; New pore-size parameter characterizing transport in porous media; Physical Review Letter; 57(20); pp. 2564-2567 (Nov. 17, 1986).
Johnson et al.; Theory of dynamic permeability and tortuosity in fluid-saturated porous media; J. Fluid Mech; 176; pp. 379-402 (Mar. 1987).
Jomaa et al., Salt-Induced Interdiffusion in Multilayers Films: A Neutron Reflectivity Study, Macromolecules; vol. 38, pp. 8473-8480; (month unavailable 2005).
Jones et al.; The viscosity of aqueous solutions of strong electrolytes with special reference to barium chloride; J. Am. Chem. Soc.; vol. 51; pp. 2950-2964; (Oct. 5, 1929).
Kiriy, Anton et al., Cascade of Coil-Globule Conformational Transitions of Single Flexible Polyelectrolyte Molecules in Poor Solvent, J. Am. Chem. Soc.; vol. 124(45); pp. 13454-13462; (Nov. 13, 2002).
Klein, F.; Affinity Membranes: a 10 Year Review; J. Membrance Sci.; vol. 179; issues 1-2; pp. 1-27; (Nov. 15, 2000).
Kobatake et al.; Flows through charged membranes. I. flip-flop current vs voltage relation; J. Chem. Phys.; 40(8); pp. 2212-2218 (Apr. 1964).
Kobatake et al.; Flows through charged membranes. II. Oscillation phenomena; J. Chem. Phys.; 40(8); pp. 2219-2222 ( Apr. 1964).

(56) References Cited

OTHER PUBLICATIONS

Kotz et al.; Principles and applications of electrochemical capacitors; Electrochimica Acta; vol. 45; issues 15-16; pp. 2483-2498; (May 3, 2000).
Kou et al.; Surface modification of microporous polypropylene membranes by plasma-induced graft polyerization of a-allyl glucoside; Langmuir; vol. 19; pp. 6869-6875; (month unavailable 2003).
Krasemann et al.; Self-assembled polyelectrolyte multilayer membranes with highly improved pervaporation separation of ethanol/water mixtures; J of Membrane Science; vol. 181; No. 2; pp.221-228; (Jan. 30, 2001).
Li et al., Studies on preparation and performances of carbon aerogel electrodes for the application of supercapacitor; Journal of Power Sources; vol. 158; pp. 784-788; (Jul. 14, 2006).
Liu et al.; Electroosmotically pumped capillary flow-injection analysis; Analytica Chimica Acta; vol. 283; issue 2; pp. 739-745; (Nov. 26, 1993).
Liu et al.; Flow-injection analysis in the capillary format using electroosmotic pumping; Analytica Chimica Acta; vol. 268; issue 1; pp. 1-6; (Oct. 7, 1992).
Losche et al., Detailed structure of molecularly thin polyelectrolyte multilayer films on solid substrates as revealed by neutron reflectometry; Macromolecules; vol. 31(25); pp. 8893-8906; (Dec. 15, 1998).
Ma et al.; A review of zeolite-like porous materials; Microporous and Mesoporous Materials; vol. 37; issues 1-2; pp. 243-252 (May 2000).
Manz et al.; Electroosmotic pumping and electrophoretic separations for miniaturized chemical analysis systems; J. Micromach. Microeng.; vol. 4; issue 4; pp. 257-265; (Dec. 1994).
Martin et al.; Laminated Plastic Microfluidic Components for Biological and Chemical Systems; J. Vac. Sci. Technol. A; Second Series; vol. 17; No. 4; part II; pp. 2264-2269; (Jul.-Aug. 1999).
Mika et al., A new class of polyelectrolyte-filled microfiltration membranes with environmentally controlled porosity, Journal of Membrane Science; vol. 108; issues 1-2; pp. 37-56; (Dec. 15, 1995).
Morrison et al.; Electrokinetic energy conversion in ultrafine capillaries; J. Chem. Phys.; vol. 43; No. 6; pp. 2111-2115 (Sep. 15, 1965).
Mroz et al.; Disposable Reference Electrode; Analyst; vol. 123;No. 6; pp. 1373-1376; (Jun. 1998).
Nakanishi et al.; Phase separation in silica sol-gel system containing polyacrylic acid; Journal of Crystalline Solids; 139; pp. 1-13; (month unavailable 1992).
Park, Juhyun et al., Polyelectrolyte Multilayer Formation on Neutral Hydrophobic Surfaces, Macromolecules; vol. 38, pp. 10542-10550; (month unavailable 2005).
Paul et al., Electrokinetic pump application in micro-total analysis systems mechanical actuation to HPLC; Micro Total Analysis Systems 2000; Proceedings of the μTAS 2000 Symposium, held in Enschede, The Netherlands; pp. 583-590; (May 14-18, 2000).
Paul et al.; Electrokinetic generation of high pressures using porous microstructures; Micro Total Analysis Systems '98; Proceedings of the μTAS '98 Workshop, held in Banff, Canada; pp. 49-52 (Oct. 13-16, 1998).
Peters et al.; Molded rigid polymer monoliths as separation media for capillary electrochromatography; Anal. Chem.; vol. 69; No. 17; pp. 3646-3649; (Sep. 1, 1997).
Philipse, A.P., Solid opaline packings of colloidal silica spheres; Journal of Materials Science Letters; 8; pp. 1371-1373 (month unavailable 1989).
Pretorius et al.; Electro-osmosis: a new concept for high-speed liquid chromatography; Journal of Chromatography; vol. 99; pp. 23-30; (month unavailable 1974).
Rastogi, R.P.; Irreversible thermodynamics of electro-osmotic effects; J. Scient. Ind. Res.; (28); pp. 284-292 (Aug. 1969).
Rice et al.; Electrokinetic flow in a narrow cylindrical capillary; J. Phys. Chem.; 69(11); pp. 4017-4024 (Nov. 1965).
Roberts et al.; UV Laser Machined Polymer Substrates for the Development of Microdiagnostic Systems; Anal. Chem.; vol. 69; No. 11; pp. 2035-2042; (Jun. 1, 1997).
Rosen, M.J.; Ch.2—Adsorption of surface-active agents at interfaces: the electrical double layer; Surfactants and Interfacial Phenomena, Second Ed., John Wiley & Sons, pp. 32-107; (Feb. 1989).
Salabat et al.; Thermodynamic and transport properties of aqueous trisodium citrate system at 298.15 K; J. Mol. Liq.; vol. 118; pp. 67-70; (Apr. 15, 2005).
Salomaeki et al., The Hofmeister Anion Effect and the Growth of Polyelectrolyte Multilayers, Langmuir; vol. 20, pp. 3679-3683; (Apr. 27, 2004).
Sankaranarayanan et al.; Chap. 1: Anatomical and pathological basis of visual inspection with acetic acid (VIA) and with Lugol's iodine (VILI); A Practical Manual on Visual Screening for Cervical Neoplasia; IARC Press; (Nov. 2003).
Schlenoff et al., Mechanism of polyelectrolyte multilayer growth: charge overcompensation and distribution; Macromolecules; vol. 34; No. 3; pp. 592-598; (Jan. 30, 2001).
Schmid et al.; Electrochemistry of capillary systems with narrow pores V. streaming potential: donnan hindrance of electrolyte transport; J. Membrane Sci.; vol. 150; issue 2; pp. 197-209 (Nov. 25, 1998).
Schmid, G.; Electrochemistry of capillary systems with narrow pores. II. Electroosmosis; J. Membrane Sci.; vol. 150; issue 2; pp. 159-170 (Nov. 25, 1998).
Schoenhoff, J.; Layered polyelectrolyte complexes: physics of formation and molecular properties, Journal of Physics Condensed Matter; vol. 15, No. 49; pp. R1781-R1808; (Nov. 25, 2003).
Schweiss et al., Dissociation of Surface Functional Groups and Preferential Adsorption of Ions on Self-Assembled Monolayers Assessed by Streaming Potential and Streaming Current Measurements, Langmuir; vol. 17, No. 14; pp. 4304-4311; (month unavailable 2001).
Skeel, Ronald T. (editor); Handbook of Chemotherapy (6th Ed.); Lippincott Williams & Wilkins; (May 30, 2003).
Stokes, V. K.; Joining Methods for Plastics and Plastic Composites: An Overview; Poly. Eng. and Sci.; vol. 29; No. 19; pp. 1310-1324; (mid-Oct. 1989).
Takamura, Y., et al.; Low-Voltage Electroosmosis Pump and Its Application to On-Chip Linear Stepping Pneumatic Pressure Source; Abstract; Micro Total Analysis Systems; pp. 230-232; (month unavailable 2001).
Takata et al.; Modification of Transport Properties of Ion Exchange Membranes; J. Membrance. Sci.; vol. 179; No. 1; pp. 101-107; (Nov. 15, 2000).
Taylor, G.; Dispersion of soluble matter in solvent flowing slowly through a tube; Prox. Roy. Soc. (London); 21; pp. 186-203; (Mar. 31, 1953).
Tuckerman et al.; High-performance heat sinking for VLSI; IEEE Electron Dev. Letts., vol. EDL-2, pp. 126-129; (May 1981).
Tusek et al.; Surface characterisation of NH3 plasma treated polyamide 6 foils; Colloids and Surfaces A; vol. 195; Nos. 1-3; pp. 81-95; (Dec. 30, 2001).
Uhlig et al.; The electro-osmotic actuation of implantable insulin micropumps; Journal of Biomedical Materials Research; vol. 17(6); pp. 931-943; (Nov. 1983).
Van Brunt, Jennifer; Armed antibodies; Signals (online magazine); 11 pgs.; Mar. 5, 2004.
Vinson, J.; Adhesive Bonding of Polymer Composites; Polymer Engineering and Science; vol. 29; No. 19; pp. 1325-1331; (Oct. 1989).
Watson et al.; Recent Developments in Hot Plate Welding of Thermoplastics; Poly. Eng. and Sci.; vol. 29; No. 19; pp. 1382-1386; (mid-Oct. 1989).
Weidenhammer, Petra et al., Investigation of Adhesion Properties of Polymer Materials by Atomic Force Microscopy and Zeta Potential Measurements, Journal of Colloid and Interface Science, vol. 180, issue 1; pp. 232-236; (Jun. 1, 1996).
Weston et al.; Instrumentation for high-performance liquid chromatography; HPLC and CE, Principles and Practice, Academic Press; (Chp. 3) pp. 82-85; (month unavailable 1997).
Wijnhoven et al.; Preparation of photonic crystals made of air spheres in titania; Science; 281; pp. 802-804 (Aug. 7, 1998).
Wong et al., Swelling Behavior of Polyelectrolyte Multilayers in Saturated Water Vapor, Macromolecules; vol. 37, pp. 7285-7289; (month unavailable 2004).

(56) References Cited

OTHER PUBLICATIONS

Yazawa, T., Present status and future potential of preparation of porous glass and its application; Key Engineering Materials; 115; pp. 125-146 (month unavailalble 1996).
Ye et al.; Capillary electrochromatography with a silica column with dynamically modified cationic surfactant; Journal of Chromatography A; vol. 855(1); pp. 137-145; (Sep. 3, 1999).
Yezek; Bulk conductivity of soft surface layers: experimental measurement and electrokinetic implications; Langmuir; vol. 21; pp. 10054-10060; (Oct. 25, 2005).
Yoo et al., Controlling Bilayer Composition and Surface Wettability of Sequentially Adsorbed Multilayers of Weak Polyelectrolytes, Macromolecules; vol. 31; No. 13; pp. 4309-4318; (month unavailable 1998).
Zeng, S. et al., "Fabrication and characterization of electroosmotic micropumps," Sensors and Actuators, B: Chemical; vol. 79; issues 2-3; pp. 107-114; (Oct. 15, 2001).
Zhang et al.; Specific ion effects on the water solubility of macromolecules: PNIPAM and the Hofmeister series; J. Am. Chem. Soc.; vol. 127; pp. 14505-14510; (Oct. 19, 2005).
Nip et al.; U.S. Appl. No. 13/465,927 entitled "Ganging Electrokinetic Pumps," filed May 7, 2012.
Nip et al.; U.S. Appl. No. 13/465,902 entitled "System and Method of Differential Pressure Control of a Reciprocating Electrokinetic Pump," filed May 7, 2012.
Nip et al.; U.S. Appl. No. 13/632,884 entitled "Electrokinetic Pump Based Wound Treatment System and Methods," filed Oct. 1, 2012.
Anex et al.; U.S. Appl. No. 14/265,069 entitled "Electrokinetic pump having capacitive electrodes," filed Apr. 29, 2014.

* cited by examiner

GEL COUPLING DIAPHRAGM FOR ELECTROKINETIC DELIVERY SYSTEMS

CROSS REFERENCE TO RELATED APPLICATIONS

This application claims priority to U.S. Provisional Application No. 61/482,889, filed May 5, 2011, and titled "GEL COUPLING FOR ELECTROKINETIC DELIVERY SYSTEMS," and to U.S. Provisional Application No. 61/482,918, filed May 5, 2011, and titled "MODULAR DESIGN OF ELECTROKINETIC PUMPS," both of which are herein incorporated by reference in their entireties.

INCORPORATION BY REFERENCE

All publications and patent applications mentioned in this specification are herein incorporated by reference to the same extent as if each individual publication or patent application was specifically and individually indicated to be incorporated by reference.

BACKGROUND

Pumping systems are important for chemical analysis, drug delivery, and analyte sampling. However, traditional pumping systems can be inefficient due to a loss of power incurred by movement of a mechanical piston. For example, as shown in FIGS. 2B and 3B, when a piston 203 is used between two diaphragms 254, 252, the piston 203 typically pushes and pulls on part of the diaphragms 254, 252, thus expanding and contracting in and out of a pumping chamber 122. This contraction and expansion pumps the fluid. Inefficiencies occur, however, because the mechanical piston 203 can only actuate the areas of the diaphragms 252, 254 with which it has contact. Other parts 255 of the diaphragms 252, 254 that are not acted upon on by the piston 203 are left to flex freely as the piston 203 is moving. As a result, fluid in contact with or near these areas of the diaphragm is unable to move, therefore robbing efficiency from the pump.

Some diaphragm designs try to compensate for such inefficiencies by using a stiffer material to avoid having the diaphragm freely flexing. This approach, however, makes the diaphragm more difficult to actuate and tends to still lower efficiency. Other conventional diaphragm designs, such as a rolling diaphragm, are easy to actuate but have larger dead volumes.

Traditional systems can also be disadvantageous because they cannot precisely deliver small amounts of delivery fluid, partly because a mechanical piston cannot be accurately stopped mid-stroke.

Moreover, traditional pumping systems can be disadvantageous because they are often large, cumbersome, and expensive. Part of the expense and size results from the fact that the current pumping systems require the engine, pump, and controls to be integrated together.

Accordingly, a pumping system is needed that is highly efficient, precise, and/or modular.

SUMMARY OF THE DISCLOSURE

In general, in one aspect, a fluid delivery system includes a first chamber, a second chamber, and a third chamber, a pair of electrodes, a porous dielectric material, an electrokinetic fluid, and a flexible member including a gel between two diaphragms. The pair of electrodes is between the first chamber and the second chamber. The porous dielectric material is between the electrodes. The electrokinetic fluid is configured to flow through the porous dielectric material between the first and second chambers when a voltage is applied across the pair of electrodes. The flexible member fluidically separates the second chamber from the third chamber and is configured to deform into the third chamber when the electrokinetic fluid flows form the first chamber into the second chamber.

This and other embodiments can include one or more of the following features. The flexible member can be configured to deform into the second chamber when the electrokinetic fluid moves from the second chamber to the first chamber. A void can occupy 5-50% of a space between a deformable portion of the first and second diaphragms. The gel material can be adhered to the first and second diaphragms. The gel material can be separable from the first or second diaphragms when a leak forms in the first or second diaphragms. The gel material can include silicone, acrylic pressure sensitive adhesive (PSA), silicone PSA, or polyurethane. The diaphragm material can include a thin-film polymer. A ratio of a diameter of the third chamber to a height of the third chamber can be greater than 5/1. A thickness of the gel in a neutral pumping position can be greater than a height of the third chamber. The flexible member can be configured to pump a deliver fluid from the third chamber when the voltage is applied across the first and second electrodes. The flexible member can be configured to stop deforming substantially instantaneously when the electrokinetic fluid stops flowing between the first and second chambers. The flexible member can be configured to at least partially conform to an interior shape of the third chamber. The gel can be configured to compress between the first and second diaphragms when the flexible member pumps fluid from the third chamber.

In general, in one aspect, a fluid delivery system includes a pump module having a pumping chamber therein, a pump engine configured to generate power to pump delivery fluid from the pumping chamber, and a flexible member. The flexible member fluidically separates the pump module from the pump engine and is configured to deflect into the pumping chamber when pressure is applied to the flexible member from the pump engine. The flexible member is configured to transfer more than 80% of an amount of power generated by the pump engine to pump delivery fluid from the pumping chamber.

This and other embodiments can include one or more of the following features. The pump engine can be an electrokinetic engine. The flexible member can include a gel between two diaphragms.

In general, in one aspect, a method of pumping fluid includes applying a first voltage to an electrokinetic engine to deflect a flexible member in a first direction to draw fluid into a pumping chamber of an electrokinetic pump, the flexible member comprising a gel between two diaphragms; and applying a second voltage opposite to the first voltage to the electrokinetic engine to deflect the flexible member into the pumping chamber to pump the fluid out of the pumping chamber.

This and other embodiments can include one or more of the following features. The method can further include stopping the application of the second voltage and stopping the pumping of fluid out of the pumping chamber substantially instantaneously with stopping the application of the second voltage. The method can further include compressing the gel between the first and second diaphragms when the flexible member is deflected into the pumping chamber. The method can further include applying the second voltage until the flexible member substantially conforms to an interior surface of the pumping chamber.

BRIEF DESCRIPTION OF THE DRAWINGS

The novel features of the invention are set forth with particularity in the appended claims. A better understanding of the features and advantages of the present invention will be obtained by reference to the following detailed description that sets forth illustrative embodiments, in which the principles of the invention are utilized, and the accompanying drawings of which:

DETAILED DESCRIPTION

Certain specific details are set forth in the following description and figures to provide an understanding of various embodiments of the invention. Certain well-known details, associated electronics and devices are not set forth in the following disclosure to avoid unnecessarily obscuring the various embodiments of the invention. Further, those of ordinary skill in the relevant art will understand that they can practice other embodiments of the invention without one or more of the details described below. Finally, while various processes are described with reference to steps and sequences in the following disclosure, the description is for providing a clear implementation of particular embodiments of the invention, and the steps and sequences of steps should not be taken as required to practice this invention.

Figure 1:
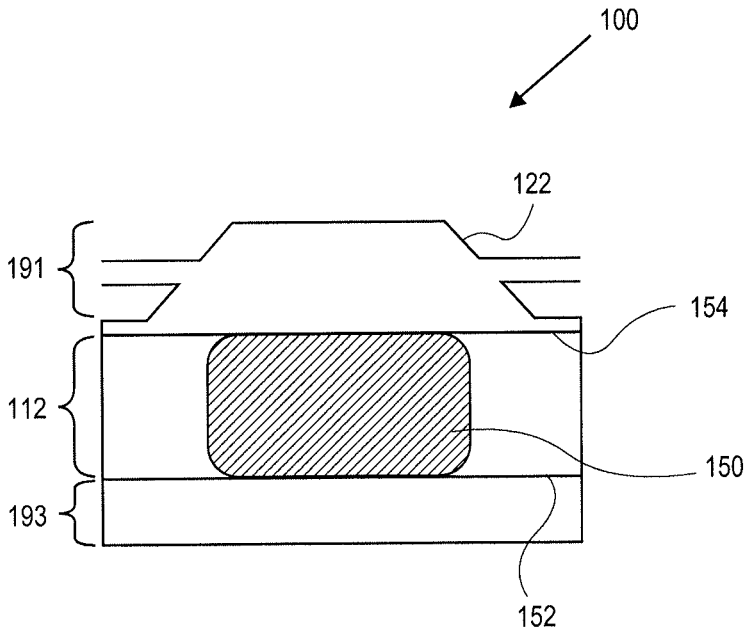
FIG. 1 is a schematic view of a pump system having a gel coupling in a neutral position.

FIG. 1 is a schematic view of a pump system 100. The pump system 100 includes a fluid pump 191 configured to deliver fluid from a fluid reservoir and a pump engine 193 configured to supply the power necessary to run the fluid pump 191. A gel coupling 112 is located between the fluid pump 191 and the pump engine 193. The gel coupling 112 is configured to transfer power from the pump engine 193 to the fluid pump 191, i.e., similar to the movement of a piston. The gel coupling 112 can include a gel-like material 150 bounded by a front diaphragm 154 and a rear diaphragm 152. Further, the diaphragms 152, 154 can be pinned between the pump 191 and the engine 193 along the outer edges such that the middle portion of the gel coupling is free to flex between the pump 191 and the engine 193 to transfer power from the engine 193 to the pump 191.

The diaphragms 152, 154 of the gel coupling 112 can be aligned substantially parallel with one another when in the neutral position shown in FIG. 1 and can have approximately the same dimensions as one another, such as the same length or diameter. Providing diaphragms that are aligned and have approximately the same dimensions allows the diaphragms to be properly coupled such that all of the power transferred from one diaphragm can be received by the other diaphragm. The diaphragms 152, 154 can be made of a thin material, e.g., less than 10 ml thick, such as less than 5 ml thick. Further, the diaphragms 152 can be made of an elastic and/or flexible material. In some embodiments, the diaphragms are made of a thin-film polymer, such as, polyethylene, silicone, polyurethane, LDPE, HDPE, or a laminate. In one embodiment, at least one of the diaphragms is made of a laminated material having a polyethylene layer adhered to a nylon layer, such as WinPak Deli*1™. Thin film polymers can advantageously improve flexibility of the gel coupling 112 as well as improve adhesion of the diaphragms to the gel-like material 150. In a specific embodiment, the diaphragms 152, 154 are made of a polyethylene film that is approximately 4 ml thick. In another specific embodiment, the diaphragms 152, 154 are made of a WinPak Deli*1™ film that is approximately 3 ml thick. The diaphragms 152, 154, in addition to transferring energy from the engine 193 to the pump 191, can also have a low moisture transmission rate and therefore function to prevent fluid, e.g., pump fluid from an EK engine or delivery fluid, from leaking out of the respective components.

The gel-like material 150 can include a gel, i.e. a dispersion of liquid within in a cross linked solid that exhibits no flow when in the steady state. The liquid in the gel advantageously makes the gel soft and compressible while the cross-linked solid advantageously makes the gel have adhesive properties such that it will both stick to itself (i.e. hold a shape) and stick to the diaphragm material. The gel-like material 150 can have a hardness of between 5 and 60 durometer, such as between 10 and 20 durometer, for example 15 durometer. Further, the gel-like material 150 can have adhesive properties such that it is attracted to the material of both diaphragms 152, 154, which can advantageously help synchronize the two diaphragms 152, 154. In some embodiments, the gel-like material 150 is a silicone gel, such as blue silicone gasket material from McMaster-Carr™ or Gel-Pak® X8. Alternatively, the gel-like material 150 can include a pressure sensitive adhesive (PSA), such as 3M™ acrylic PSA or 3M™ silicone PSA. In other embodiments, the gel-like material can be a low durometer polyurethane.

The gel-like material 150 can have a thickness that is low enough to remain relatively incompressible, but high enough to provide proper adhering properties. For example, the gel-like material 150 can be between 0.01 to 0.1 inches thick, such as between 0.01 and 0.06 inches thick. In one embodiment, the flexible member, including the gel, has a thickness that is greater than the height of the pumping chamber 122. For example, the thickness of the gel coupling 112 can be approximately 1.5 to 2 times the height of the pumping chamber 122. The gel-like material can have a Poisson's ratio of approximately 0.5 such that, when compressed in one direction, it expands nearly or substantially the same amount in a second direction. Further, the gel-like material 150 can be chemically stable when in contact with the diaphragms 152, 154 and can be insoluble with water, pump fluids, or delivery fluids.

Figure 2A:
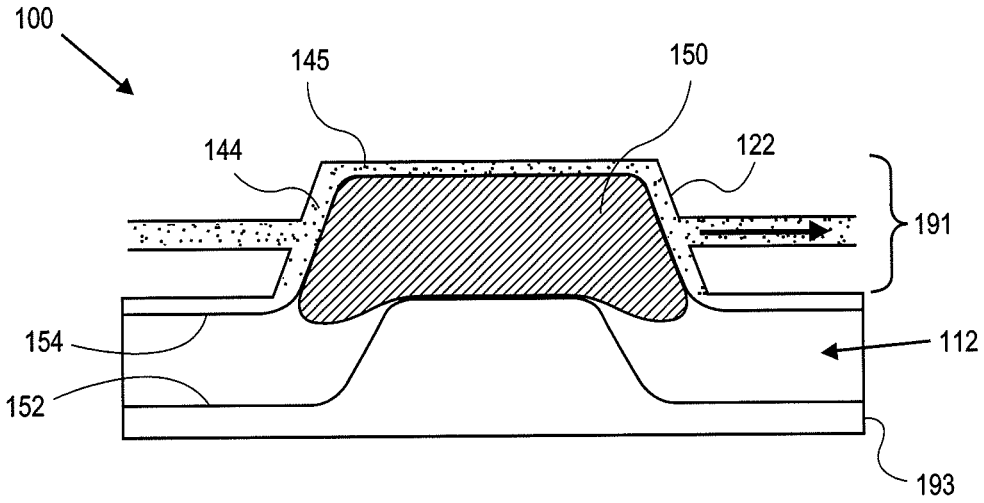
FIG. 2A is a schematic view of a gel coupling in the outtake position to deliver fluid.
Figure 2B:
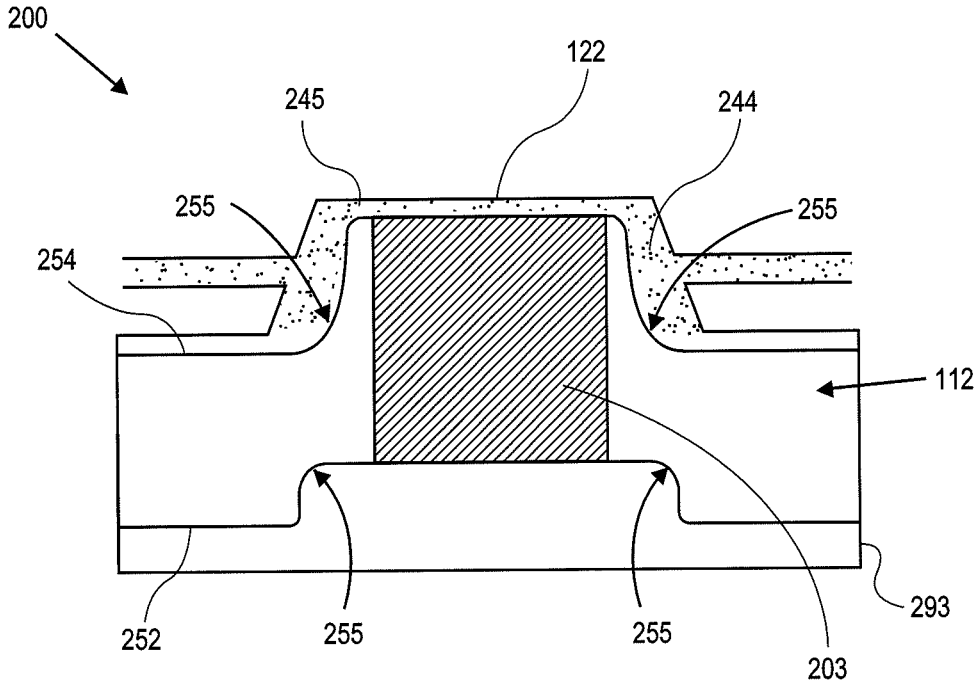
FIG. 2B (PRIOR ART)
FIG. 2B is a schematic view of the movement of a traditional piston in the outtake position to deliver fluid.

Referring to FIG. 2A, the gel coupling 112 can be flexible so as to deform or deflect towards the pump 191 when positive pressure is placed upon the member 112 by the pump engine 193. Thus, as the positive pressure is applied to the gel coupling by the pump engine 193, at least a portion of the gel coupling 112 will move into the chamber 122 of the fluid pump 191 and at least partially conform to the shape of the chamber 122, thereby pump fluid 145 out of the chamber 122. The flexibility of the gel coupling 112 can advantageously reduce the amount of dead volume 144, i.e. volume of pump fluid 145 not displaced by the gel coupling 112, caused during pumping, thereby improving the efficiency of the pump relative to a mechanical piston. That is, referring to FIG. 2B, a system 200 having a mechanical piston 203 between two diaphragms 252, 254 can create a significant amount of dead volume 244 as the piston is pumped by the engine 293 due to the unsupported portions 255 of the diaphragms 252, 254 that cannot push fluid and rather flex freely as the piston moves. In contrast, the gel coupling 112 having the gel-like material 150 has significantly less dead volume 144 because the gel 150 can compress between the diaphragms 152, 154, reducing the distance between the diaphragms, and expand laterally. This expansion laterally causes the area of the diaphragm 154 that would be unsupported by the piston 203 (FIG. 2B) to be supported by the expanded gel-like material 150 (FIG. 2A), allowing more fluid to flow out of the pump 191.

Figure 3A:
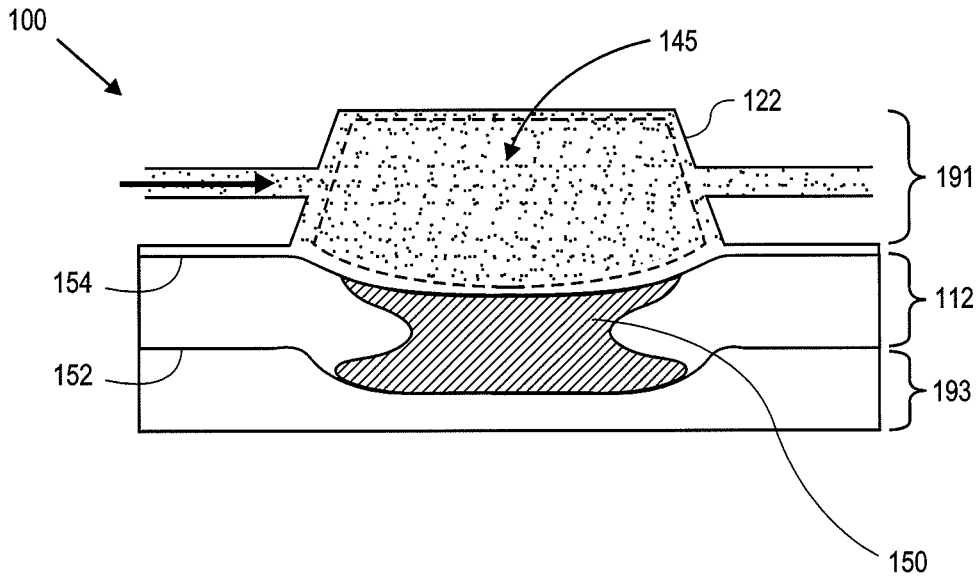
FIG. 3A is a schematic view of a gel coupling in an intake position to draw fluid into the pump.
Figure 3B:
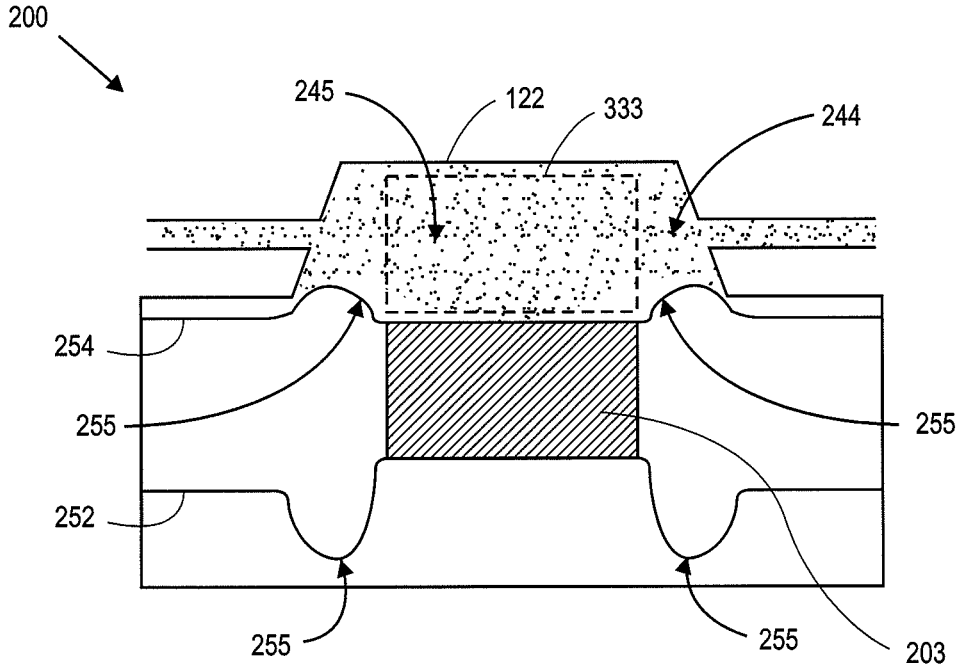
FIG. 3B (PRIOR ART)
FIG. 3B is a schematic view of the movement of a traditional piston in an intake position to draw fluid into the pump.

Referring to FIG. 3A, during the reverse stroke, when negative pressure is placed upon the flexible member by the pump engine 193, the flexible member 112 can again be flexible so as to deform. Thus, as the diaphragm 154 pulls back on the gel-like material 150, the adhesion properties of the gel-like material 150 will transfer the pulling force to the diaphragm 152 and pull pump fluid 145 into the chamber 122. The gel-like material 150 advantageously pulls in areas where a mechanical piston would not. That is, referring to FIG. 3B, the piston 203 driven in reverse will pump a volume of pump fluid 245 equal to the size of the piston, as shown by the dotted line 333. However, the areas 255 of the membranes 254, 252 unsupported by the piston 203 will not move as much and will therefore create a stagnant or dead volume 244, which will result in less fluid 245 being pumped into the chamber 122. In contrast, the gel-coupling gel coupling 112 will remain adhered to the diaphragms 152, 154 in the laterally expanded state. Thus, as shown in FIG. 3A, as the diaphragm 152 pulls on the gel-like material 150, the center of the gel-like material will thin while the edges remain adhered to the diaphragms 152, 154. Accordingly, more of the diaphragm 154 will pull on fluid 145 into the pumping chamber (shown by the dotted line in FIG. 3A) relative to that pulled in by the piston 203 (shown by the dotted line in FIG. 3B).

In some embodiments, the gel coupling 112 can be located within a fixed volume space, such as the chamber 122, so that movement of the gel coupling 112 is limited by the fixed volume. In some embodiments, the expanded shapes of the diaphragms 152, 154 limit the amount of movement of the gel coupling 112. For example, the diaphragms 152, 154 can include a thin polymer with a low bending stiffness but a high membrane stiffness such that the gel coupling 112 can only move a set distance. Having a shaped diaphragm can be advantageous because the shaped diaphragm undergoes little stretching, and stretching can problematically cause the gel-like material to decouple from the diaphragm after several cycles of stretching.

Figure 4:
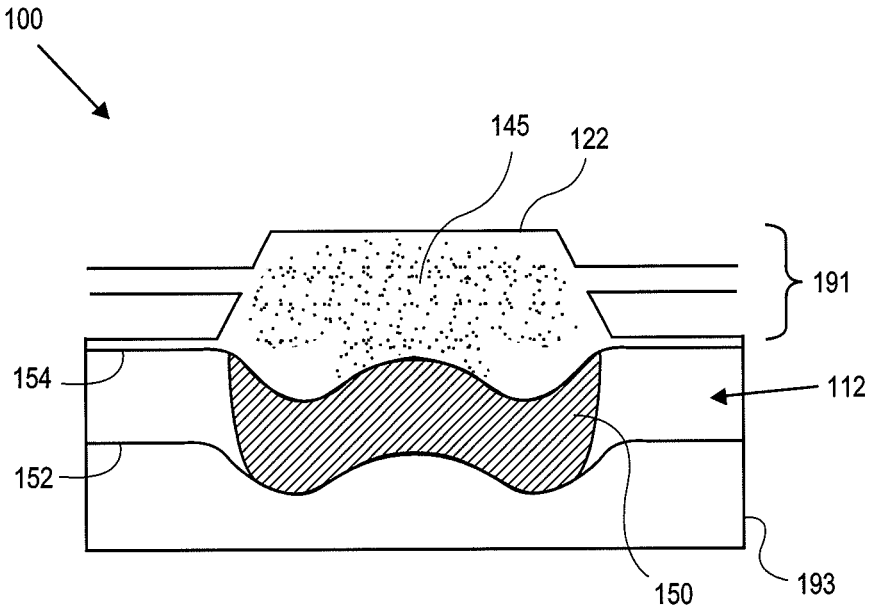
FIG. 4 is a schematic view of a partial stroke of a gel coupling.

The gel coupling 112 can be configured to move only based upon the amount of power supply by the engine 193. That is, because the gel coupling 112 is pliable and has little inertia and mechanical stiffness to overcome, it can stop substantially instantaneously when the engine 193 stops generating power. The gel coupling 112 will only have to overcome a small local pressure in order to actuate the drive volume and/or stop pumping. As a result, referring to FIG. 4, the gel coupling 112 can be stopped mid-stroke, i.e. before reaching the edge of the chamber 122, to displace only a small volume of fluid 145. For example, less than 20% of the total stroke volume can be displaced, such as less than 10%, such as approximately 5%.

Figure 5A:
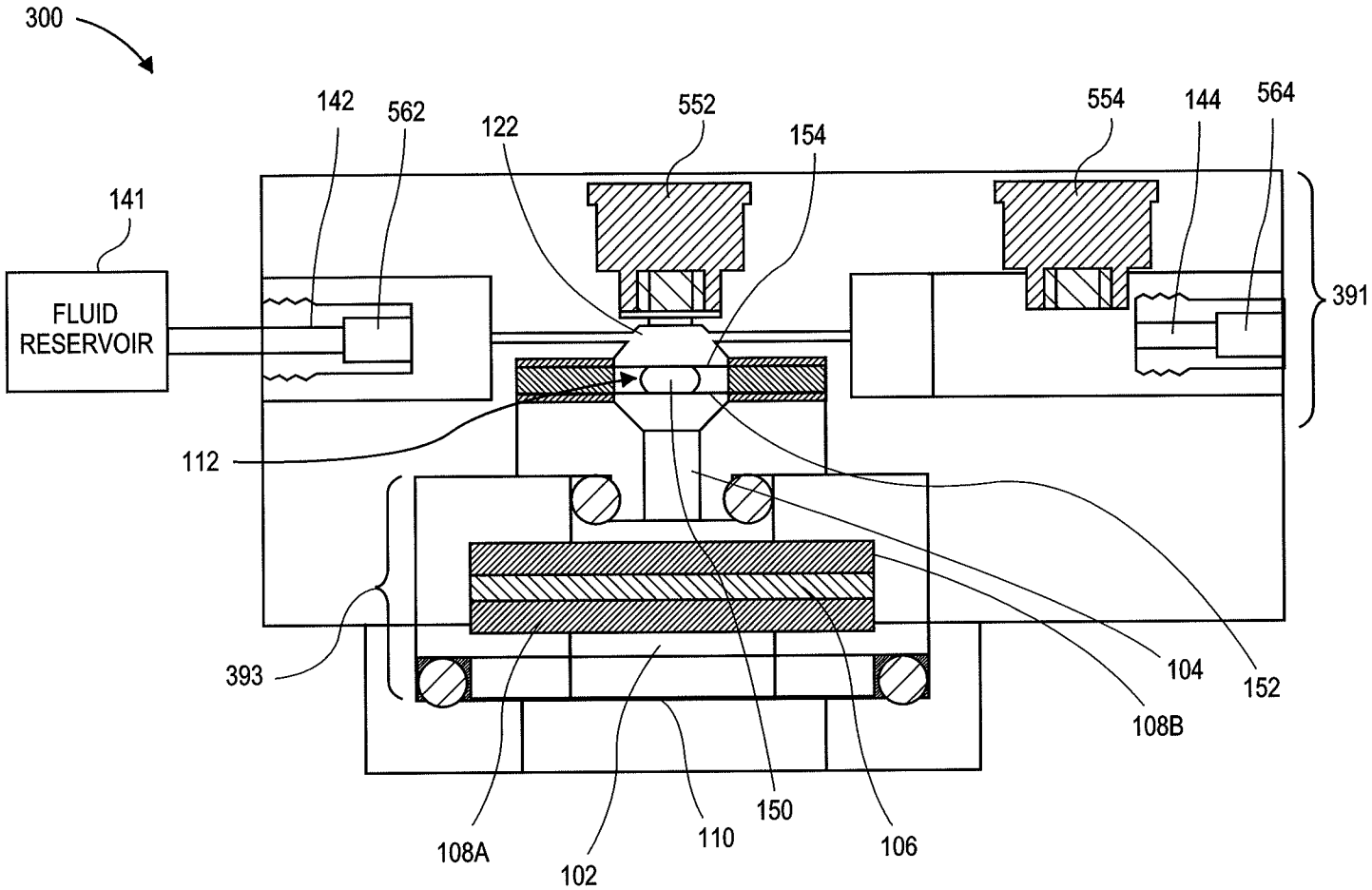
FIG. 5A is a schematic view of an electrokinetic ("EK") system having a gel coupling in a neutral position.

In one embodiment, referring to FIG. 5A, the gel coupling 112 can be used in an electrokinetic ("EK") pump system 300. The EK pump system 300 includes a pump 391 and an EK engine 393. The engine 393 includes a first chamber 102 and a second chamber 104 separated by a porous dielectric material 106, which provides a fluidic path between the first chamber 102 and the second chamber 104. Capacitive electrodes 108*a* and 108*b* are disposed within the first and second chambers 102, 104, respectively, and are situated adjacent to or near each side of the porous dielectric material 106. The electrodes 108*a*, 108*b* can comprise a material having a double-layer capacitance of at least $10^{-4}$ Farads/cm$^2$, such as at least $10^{-2}$ Farads/cm$^2$. The EK engine 393 further includes a movable member 110 opposite the electrode 108*a*, for example a flexible impermeable diaphragm. The first and second chambers 102 and 104, including the space between the porous dielectric material 106 and the capacitive electrodes 108*a* and 108*b*, are filled with an electrolyte or EK pump fluid. The pump fluid may flow through or around the electrodes 108*a* and 108*b*. The capacitive electrodes 108*a* and 108*b* are connected to an external voltage source by lead wires or other conductive media.

The pump 391 further includes a third chamber 122. The third chamber 122 can include a delivery fluid, such as a drug, e.g., insulin. A supply cartridge 142 can be connected to the third chamber 102 for supplying the delivery fluid to the third chamber 122, while a delivery cartridge 144 can be connected to the third chamber 122 for delivering the delivery fluid from the third chamber 122, such as to a patient. The gel coupling 112 can separate the delivery fluid in the third chamber 122 and the pump fluid in the second chamber 104.

The pump system 300 can be used to deliver fluid from the supply cartridge 142 to the delivery cartridge 144 at set intervals. To start delivery of fluid, a voltage correlating to a desired flow rate and pressure profile of the EK pump can be applied to the capacitive electrodes 108*a* and 108*b* from a power source. A controller can control the application of voltage. For example, the voltage applied to the EK engine 393 can be a square wave voltage. In one embodiment, voltage can be applied pulsatively, where the pulse duration and frequency can be adjusted to change the flow rate of EK pump system 300. The controller, in combination with check valves 562 and 564 and pressure sensors 552 and 554 can be used to monitor and adjust the delivery of fluid. Mechanisms for monitoring fluid flow are described further in U.S. patent application Ser. No. 13/465,902, filed herewith, and titled "SYSTEM AND METHOD OF DIFFERENTIAL PRESSURE CONTROL OF A RECIPROCATING ELECTROKINETIC PUMP."

Referring to FIG. 5A, the gel coupling 112 in the EK system 300 can be in a neutral position in the chamber 112.

Figure 5B:
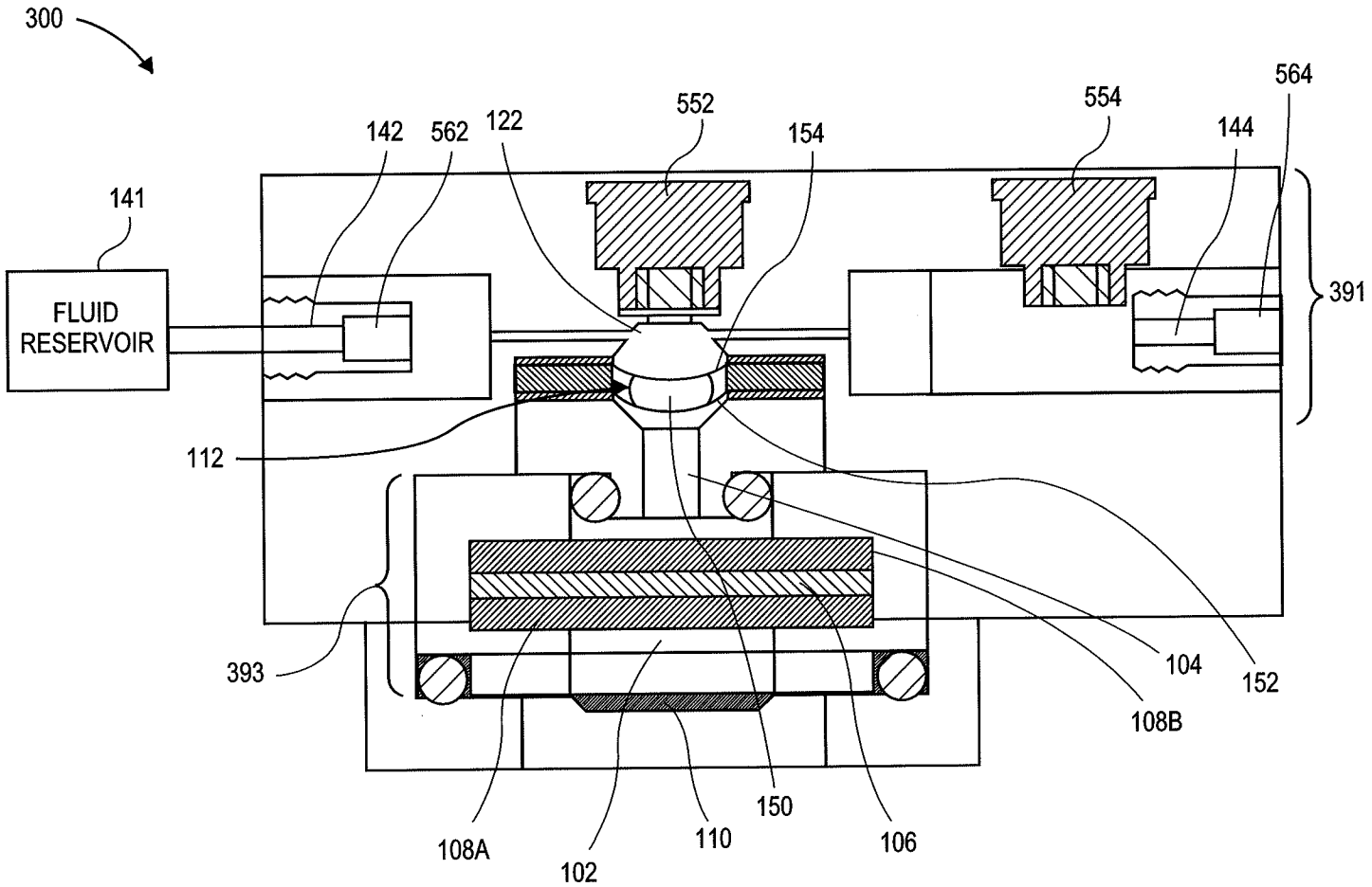
FIG. 5B is a schematic view of the EK system of FIG. 5A with the gel coupling in the intake position.

Referring to FIG. 5B, as a voltage, such as a forward voltage, is applied to the electrodes 108*a*, 108*b*, pump fluid from the second chamber 104 is moved into the first chamber 102 through the porous dielectric material 106 by electro-osmosis. The movement of pump fluid from the second chamber 104 to the first chamber 102 causes the movable member 110 to expand from a neutral position shown in FIG. 5A to an expanded position shown in FIG. 5B to compensate for the additional volume of pump fluid in the first chamber 102. Further, because the gel coupling 112 is in fluid communication with the pump fluid, it will be pulled towards the EK engine 393, as shown in FIG. 5B. When the gel coupling 112 has been pulled all the way, a fixed volume of delivery fluid can be pulled from the supply cartridge 142 into the third chamber 122 (called the "intake stroke").

Figure 5C:
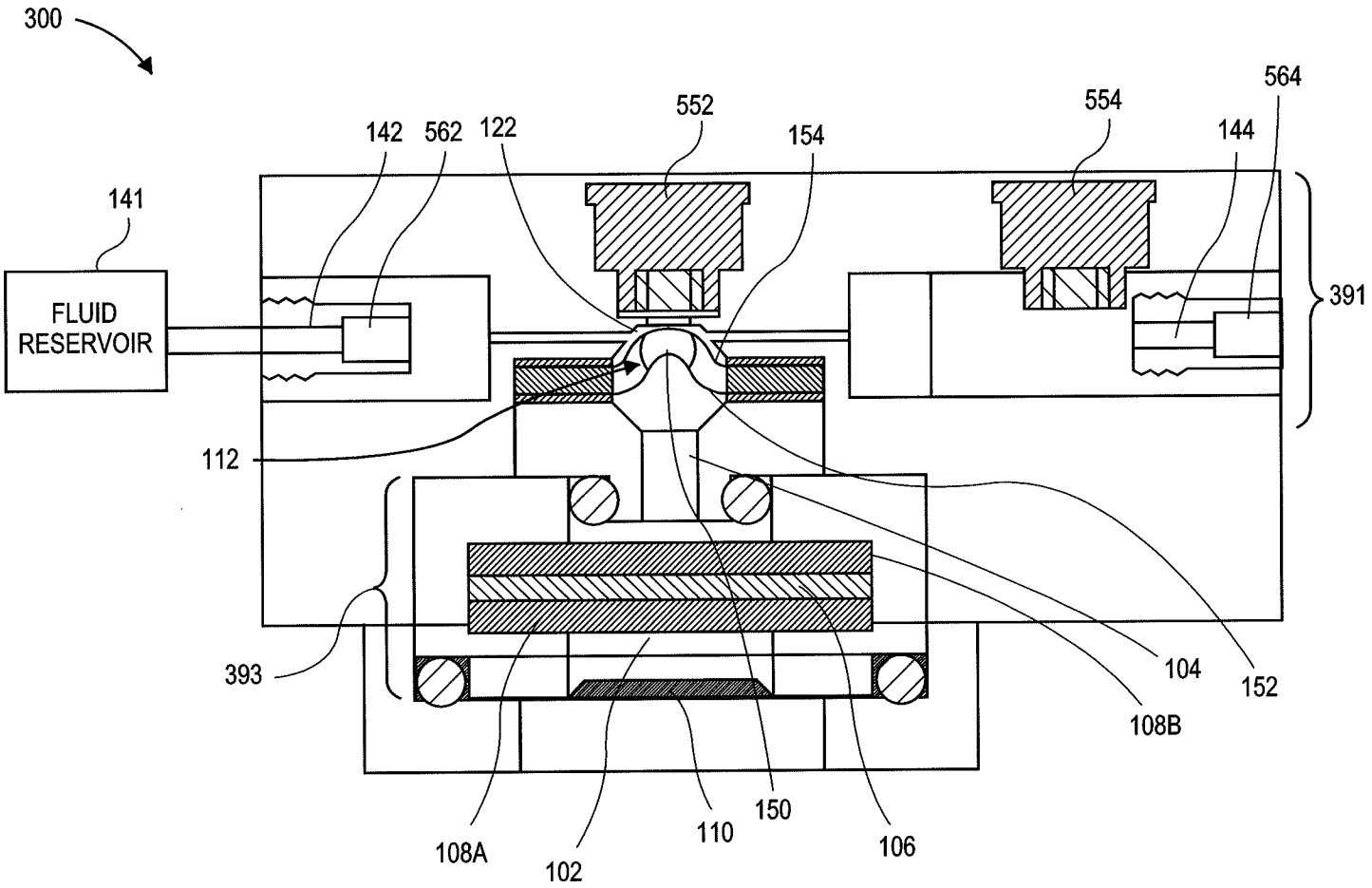
FIG. 5C is a schematic view of the EK system of FIG. 5A with the gel coupling movable member in the outtake position.

Referring to FIG. 5C, the flow direction of pump fluid can be reversed by toggling the polarity of the applied voltage to capacitive electrodes 108*a* and 108*b*. Thus, applying a reverse voltage (i.e., toggling the polarity of the forward voltage) to the EK engine 393 causes the pump fluid to flow from the first chamber 102 to the second chamber 104. As a result, the movable member 110 is pulled from the expanded position shown in FIG. 5B to the retracted position shown in FIG. 5C. Further, the gel coupling 112 is pushed by the pump fluid from the intake position of FIG. 5B to the delivery position of FIG. 5C. In this position, the gel-like material 150 fully compresses, causing the gel coupling 112 to substantially conform to the shape of the third chamber 122 and support areas of the diaphragm that would otherwise be unsupported. As a result, the volume of delivery fluid located in the third chamber 122 is pushed into the delivery cartridge 144, for example, for delivery to a patient (called the "outtake stroke").

The EK pump system 300 can be used in a reciprocating manner by alternating the polarity of the voltage applied to capacitive electrodes 108*a* and 108*b* to repeatedly move the gel coupling 112 back and forth between the two chambers 122, 104. Doing so allows for delivery of a fluid, such as a medicine, in defined or set doses.

When the electrokinetic pump system 300 is used as a drug administration set, the supply chamber 142 can be connected to a fluid reservoir 141 and the delivery chamber 144 can be connected to a patient, and can include all clinically relevant accessories such as tubing, air filters, slide clamps, and back check valves, for example.

The electrokinetic pump system 300 can be configured to stop pumping in a particular direction, i.e. with negative or positive current, prior to the occurrence of a Faradaic process in the liquid. Accordingly, the electrodes will advantageously not generate gas or significantly alter the pH of the pump fluid. The set-up and use of various EK pump systems are further described in U.S. Pat. Nos. 7,235,164 and 7,517,440, the contents of which are incorporated herein by reference.

Figure 5D:
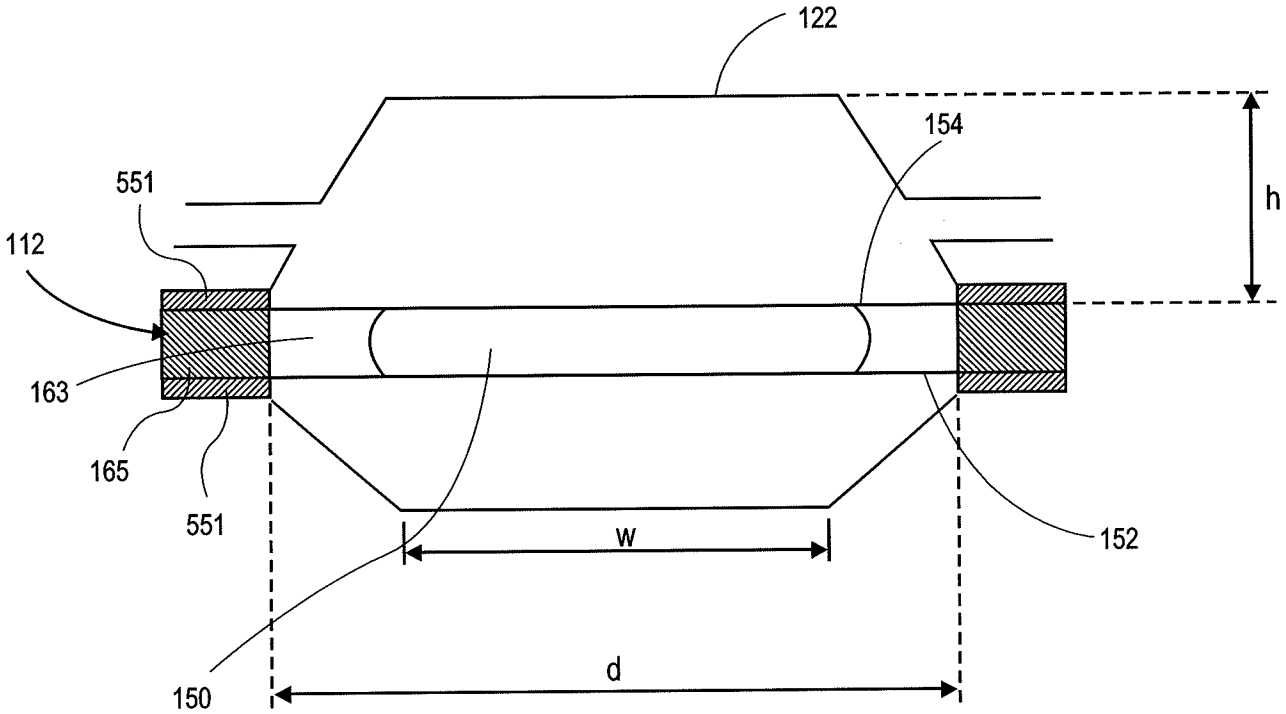
FIG. 5D is a close-up of the movable member of FIG. 5A.
Figure 6:
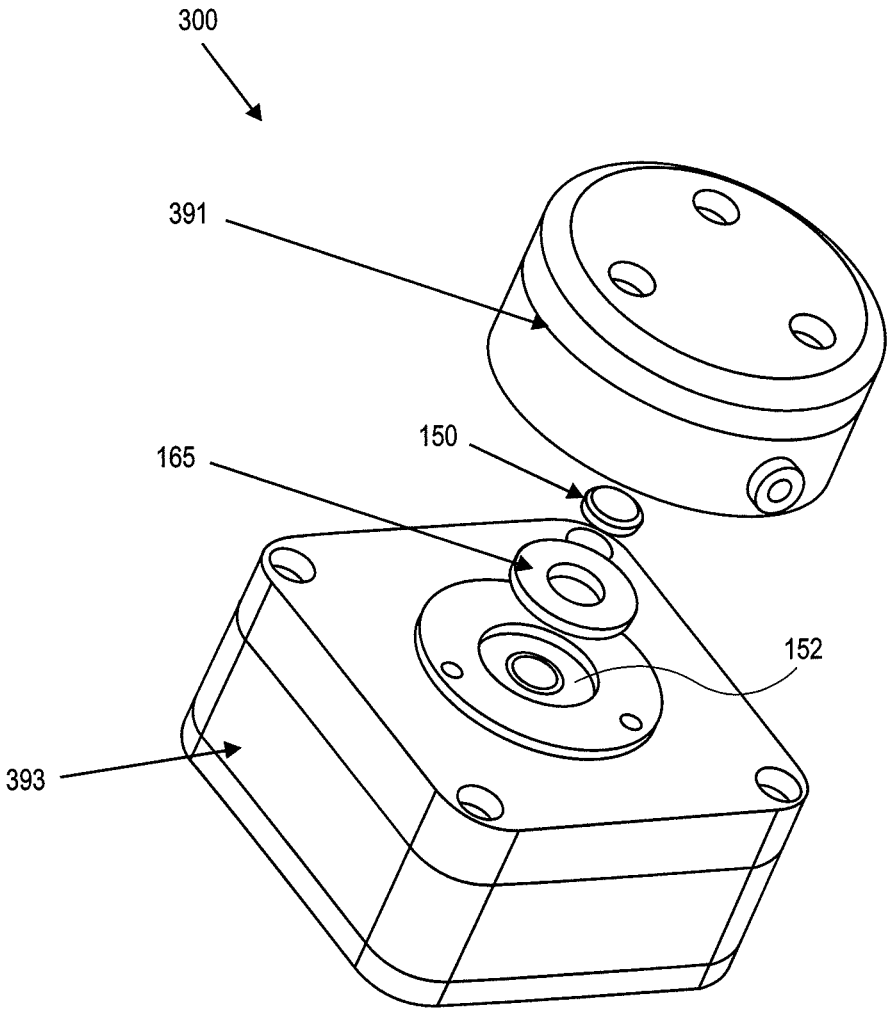
FIG. 6 shows the modularity of the assembly of pumps having a gel coupling movable member.

Referring to FIGS. 5D and 6, the gel coupling 112 can be pinned or attached into the system 300 between the pump 391 and the engine 393. For example, a spacer 165, such as a spacing ring, can clamp the upper diaphragm 154 to the pump 391 and the lower diaphragm 152 to the engine 393. An adhesive 551 can attach the diaphragms 152, 154 to the spacer 165. The gel-like material 150 can sit inside of the spacer 165 and between the two diaphragms 152, 154. The attachment of the diaphragms 152, 154 only at the outer diameter allows the gel coupling 112 to flex or deform in the central region when pressure is applied on either side of the coupling 112.

As shown in FIG. 5D, the gel 150 can extend only part of the diameter or length of the diaphragms 152, 154. A void 163 filled with air can be located between the two diaphragms, such as between the spacer 165 and the gel-like material 150. As shown, the gel-like material 150 can occupy approximately 50% to 95%, such as 70% to 80%, of the space between the movable portions of the two diaphragms 152, 154, while the void 163 can occupy the rest of the space, such as 5-50% or 20-30%. The void 163 is advantageous because the gel-like material 150, when it compresses and expands laterally, has a place to expand into. Further, the void 163 is advantageous because, if there is a leak in one of the diaphragms 152/254, the void 163 provides a place for the fluid to flow, thereby wetting the gel-like material 150 and allowing it to separate from one or both of the diaphragms 152/154 to stop the pump from pumping. In one embodiment, the system includes a weep-hole connected to the void 163, such as through the spacer 165, such that leaking fluid can flow out of the system.

In one embodiment, shown in FIG. 5D, the pumping chamber 122 is pre-shaped in a flattened dome structure, and the gel-like material 150 extends approximately the width w of the flattened portion. In another embodiment, the diaphragms 152, 154 are pre-shaped in the flattened dome structure, and the gel similarly aligns with the width of the flattened portion. In these embodiments, the gel-like material 150, when compressed against the diaphragms, can be configured to spread out into the sloped portions, such as shown in FIG. 2A. Thus, the gel-like material 150 can expand to fill in and support substantially all of the exposed area of the diaphragm 154.

Referring to FIG. 5D, the chamber 122 can have a large diameter d relative to its height h. For example, the ratio of the diameter to the height can be greater than 3/1, such as greater than 5/1, such as between 6/1 and 20/1, such as approximately 15/1. By having a large diameter relative to the height, the diaphragms 152, 154 will advantageously have less unsupported area. As a result, a chamber of the substantially the same volume but a greater diameter/height ratio can advantageously deliver more fluid because more of the area of each of the diaphragms will be involved in pulling and pumping fluid. For example, a flattened dome-shaped chamber of 0.2 inches in diameter by 0.03 inches high and wall angle of approximately 45 degrees can deliver about 30 μl of fluid, which is about 90% of the calculated volume of the chamber. In contrast, a flattened dome-shaped chamber of 0.275 inches in diameter by 0.02 inches high and a wall angle of approximately 45 degrees can deliver about 45 μl of fluid, which is about 99% of the calculated volume. Having a pumping chamber with a large diameter relative to the height can also advantageously make the system "self-priming," i.e. create a low enough "dead volume" that the system does not have to be flushed prior to use to remove unwanted air.

Advantageously, having a gel coupling in a pump system can serve to separate any fluid in the engine, such as electrolyte in an EK pump, from delivery fluid in the pump. Separating the fluids ensures, for example, that pumping fluid will not accidentally be delivered to a patient.

Moreover, if a crack or hole is formed in either diaphragm of the gel coupling, the gel-like material will separate from the diaphragms. Since the gel-like material is lightly adhered to the diaphragm due to the adhesive properties of the gel material, such as through Van der Waal forces, it can separate from the diaphragms easily when wetted. Thus, if a diaphragm breaks or has a pin hole, either the pumping liquid or the delivery liquid can seep into the area where the gel is located. The liquid will then cause the gel and diaphragms to separate, thus causing the pump system to stop working. This penetration can be enhanced by having a void between the diaphragms filled with air, as the wetting agent can fill in the void to keep the pump system from working. Having the pump system stop working all together advantageously ensures that the pump is not used while delivering an incorrect amount of fluid, providing a failsafe mechanism.

The low durometer of the gel-like material advantageously allows for strong coupling between the two diaphragms of the gel coupling. That is, because the gel-like material has a low durometer and low stiffness, any change in shape of one diaphragm can be mimicked by the gel-like material and thus translated to the other diaphragm. The low durometer, in combination with the adhesive properties of the gel material, allows more than 50%, such as more than 80% or 90%, for example about 95%, of the power generated by the pump engine to be transferred to the delivery fluid. This high percentage is in contrast to mechanical pistons, which generally only transfer 40-45% of the power created by the piston. Further, because the gel coupling can transfer a high percentage of the power, the gel coupling is highly efficient. For example, a gel coupling in an electrokinetic pump system can pump at least 1200 ml of delivery fluid when powered by 2 AA alkaline batteries using 2800 mAh of energy. The gel coupling in an electrokinetic pump can further pump at least 0.15 mL, such as approximately 0.17 mL, of delivery fluid per 1 mAh of energy provided by the power source. Thus, for hydraulically actuated pumps such as an electrokinetic pump, the gel coupling can achieve nearly a one-to-one coupling such that whatever pump fluid is moved through the engine is transferred to the same amount of fluid being delivered from the pump.

Further, the gel coupling, when used with an electrokinetic pump system, advantageously allows for the pump to provide consistent and precise deliveries that are less than a full stroke. That is, because the EK engine delivers fluid only when a current is present, and because the amount of movement of the gel coupling is dependent only on the amount of pressure placed on it by the pump fluid rather than momentum, the gel coupling can be stopped "mid-stroke" during a particular point in the pumping phase. Stopping the gel coupling mid-stroke during a particular point in the pumping phase allows for a precise, but smaller amount of fluid to be delivered in each stroke. For example, less than 50%, such as less than 25%, for example approximately 10%, of the volume of the pumping chamber can be precisely delivered. The ability to deliver a precise smaller amount of fluid from an EK pumping system advantageously increases the dynamic range of flow rates available for the pump system.

The gel coupling is advantageously smaller than a mechanical piston, allowing the overall system to be smaller and more compact.

The coupling of the engine and pump together in the gel coupling advantageously allows the engine, such as the EK engine, and the pumping mechanism to be built separately and assembled together later. For example, as shown in FIG. 6, the pump 391 can be separate from the engine 393. After the pump 391 and engine 393 have been separately assembled (e.g., the pump 391 could be prefilled with pump fluid), then the overall system 300 can be assembled by placing the gel-like material 150 in between the pump 391 and the engine 393. The entire system can be connected with a set of screws. The coupling can also advantageously allow the same engine to be used with multiple pumps. Further, the coupling can advantageously allow the pumping mechanism to be prefilled and then attached to the EK pump.

Figure 7:
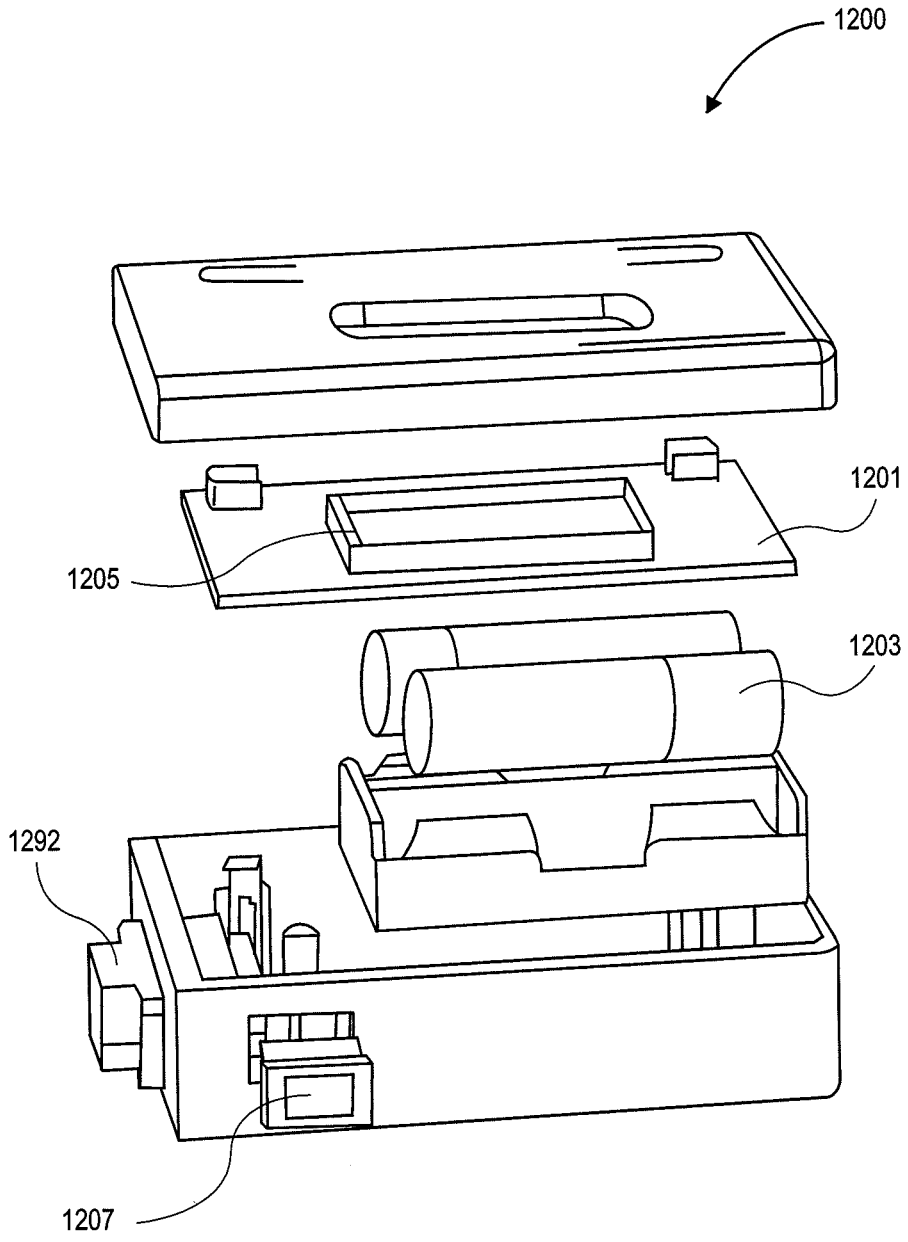
FIG. 7 is an exploded view of a control module for an EK pump module.

In addition to the gel coupling, the modularity of the overall system can be increased by having separable controls and pump systems. For example, referring to FIG. 7, a control module 1200 can be configured to apply the voltage necessary to pump fluid through the EK pump module (which includes both the EK pump and the EK engine discussed above). The control module 1200 can include a power source, such as a battery 1203, for supplying the voltage, and a circuit board 1201 including the circuitry to control the application of voltage to the pump module. The control module can further include a display 1205 to provide instructions and/or information to the user, such as an indication of flow rate, battery level, operation status, and/or errors in the system. An on-off switch 1207 can be located on the control module to allow the user to switch the control module on and off.

Figure 8:
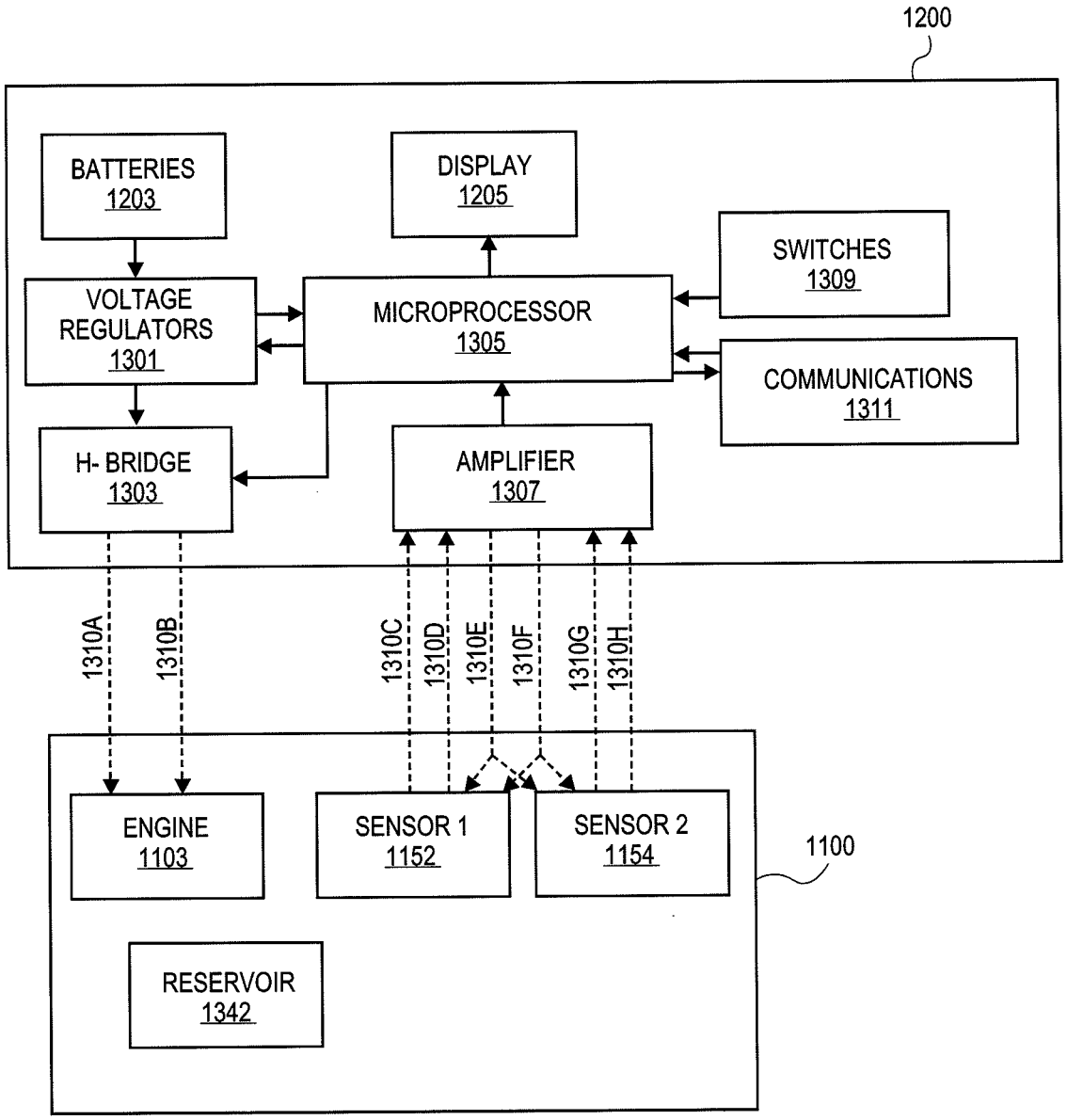
FIG. 8 is a schematic diagram of the electrical connections between components of an EK pump module and components of a control module.

Referring to FIG. 8, the circuit board in the control module 1200 includes voltage regulators 1301, an H-bridge 1303, a microprocessor 1305, an amplifier 1307, switches 1309, and communications 1311. Electrical connections 1310 between the components of the control module 1200 and components of the pump module 1100 enable the control module 1200 to run the pump module 1100. The control module can provide between 1 and 20 volts, such as between 2 and 15 volts, for example 2.6 to 11 volts, specifically 3 to 3.5 volts, and up to 150 mA, such as up to 100 mA, to the pump module 1100.

In use, the batteries 1203 supply voltage to the voltage regulators 1301. The voltage regulators 1301, under direction of the microprocessor 1305, supply the required amount of voltage to the H-bridge 1303. The H-Bridge 1303 in turn supplies voltage to the EK engine 1103 to start the flow of fluid through the pump. The amount of fluid that flow through the pump can be monitored and controlled by the pressure sensors 1152, 1154. Signals from the sensors 1152, 1154 to the amplifier 1307 in the control module can be amplified and then transmitted to the microprocessor 1305 for analysis. Using the pressure feedback information, the microprocessor 1305 can send the proper signal to the H-bridge to control the amount of time that voltage is applied to the engine 1103. The switches 1309 can be used to start and stop the engine 1103 as well as to switch between modes of pump module operation, e.g., from bolus to basal mode. The communications 1311 can be used to communicate with a computer (not shown), which can be used for diagnostic purposes and/or to program the microprocessor 1305.

As shown in FIG. 8, the pump module 1100 and the control module 1200 can have at least eight electrical connections extending therebetween. A positive voltage electrical connection 1310*a* and a negative voltage electrical connection 1310*b* can extend from the H-bridge 1303 to the engine 1103 to supply the appropriate voltage. Further, an s+ electrical connection 1310*c*, 1310*g* and an s− electrical connection 1310*d*, 1310*h* can extend from sensors 1152, 1154, respectively, such that the difference in voltage between the s+ and s− connections can be used to calculate the applied pressure. Moreover, a power electrical connection 1310*e* can extend from the amplifier 1307 to both sensors 1152, 1154 to power the sensors, and a ground electrical connection 1310*f* can extend from the amplifier 1307 to both sensors 1152, 1154 to ground the sensors.

Figure 9A:
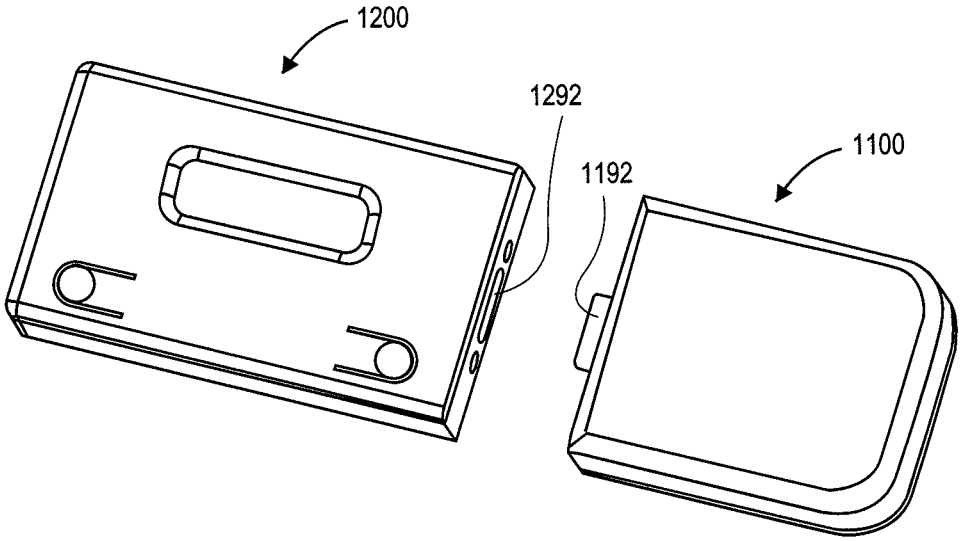
FIG. 9A is a top view of a modular EK pump.
Figure 9B:
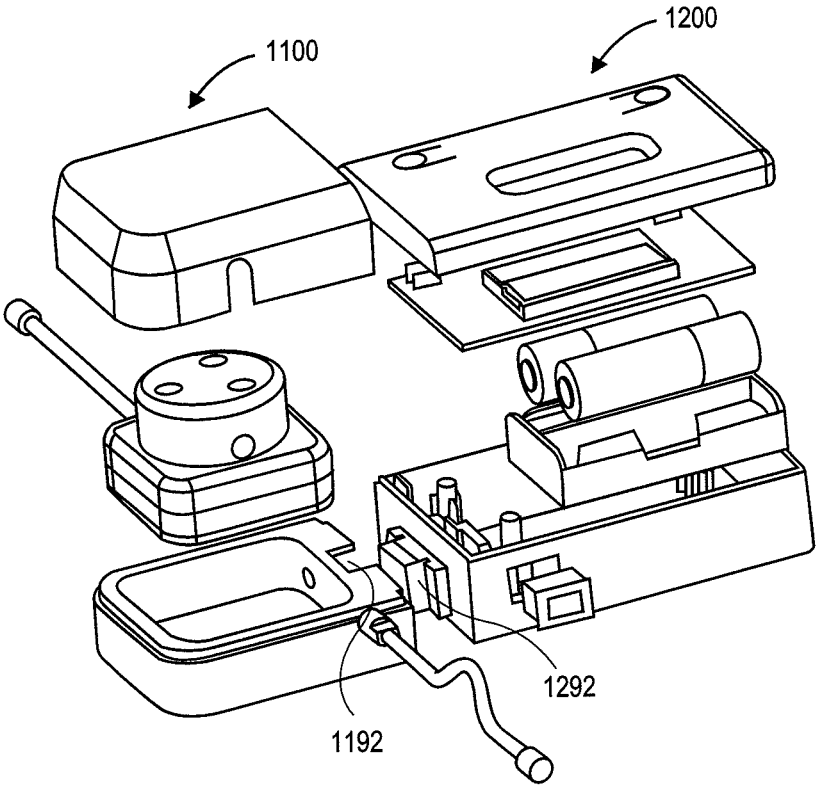
FIG. 9B is an exploded view of the modular EK pump of FIG. 9A.

Referring to FIGS. 9A and 9B, the pump module 1100 and the control module 1200 can be configured to connect together mechanically so as to ensure that the required electrical connections are made. Thus, pump module 1100 can include a pump connector 1192, and the control module 1200 can include a module connector 1292 that attaches to or interlocks with the pump connector 1192. The mechanical connection between the pump module 1100 and control module 1200 can be, for example, a spring and lever lock, a spring and pin lock, a threaded connector such as a screw.

Figure 10:
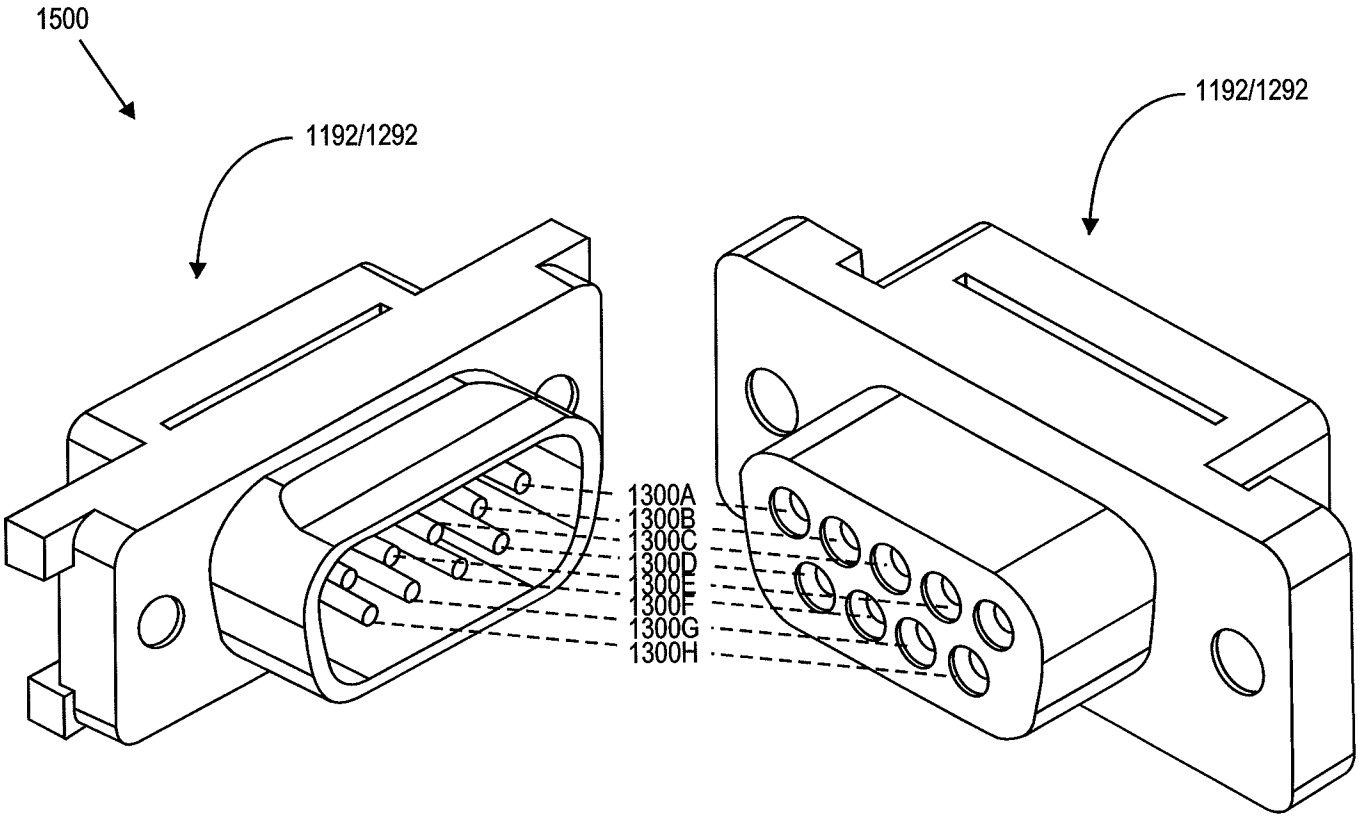
FIG. 10 shows an exemplary connection between a control module and an EK pump module.

The connectors 1192 can provide not only the mechanical connections between the pump module 1100 and control module 1200, but also the required electrical connections. For example, as shown in FIG. 10, a nine-pin connector 1500 can be used to provide the required mechanical and electrical connections 1310*a*-1310*h*. Other acceptable connectors with minimum of 8 connections are molex, card edge, circular, mini sub-d, contact, or terminal block.

The electrical and mechanical connections between the pump module 1100 and the control module 1200 are configured to function properly regardless of the type of pump module 1100 used. Accordingly, the same control module 1200 can be consecutively connected to different pump modules 1100. For example, the control module 1200 could be attached to a first pump module that produces a first flow rate range, such as a flow rate range 0.1-5 ml/hr. The control module 1200 could then be disconnected from the first pump module and attached to a second pump module that runs at the same flow rate range or at a second, different flow rate range, such as 1 ml-15 ml/hr. Allowing the control module 1200 to be connected to more than one pump allows the pump modules to be packaged and sold separately from the control module, resulting in lower-priced and lower-weight pump systems than are currently available. Moreover, using a single control module 1200 repeatedly allows the user to become more familiar with the system, thereby reducing the amount of human error incurred when using a pump system. Further, having a separate control module and pump module can advantageously allow, for example, for each hospital room to have a single controller than can be connected to any pump required for any patient.

Moreover, because the control module 1200 and the pump modules can be individually packaged and sold, the pump module can be pre-primed with a delivery fluid, such as a drug. Thus, the reservoir 1342 and the fluid paths can be filled with a delivery fluid prior to attachment to a control module 1200. When the pump module 1100 is pre-primed, substantially all of the air has been removed from the reservoir and fluid paths. The pump module 1100 can be pre-primed, for example, by the pump manufacturer, by a delivery fluid company, such as a pharmaceutical company, or by a pharmacist. Advantageously, by having a pre-primed pump module 1100, the nurse or person delivering the fluid to the patient does not have to fill the pump prior to use. Such avoidance can save time and provide an increased safety check on drug delivery.

Figure 11:
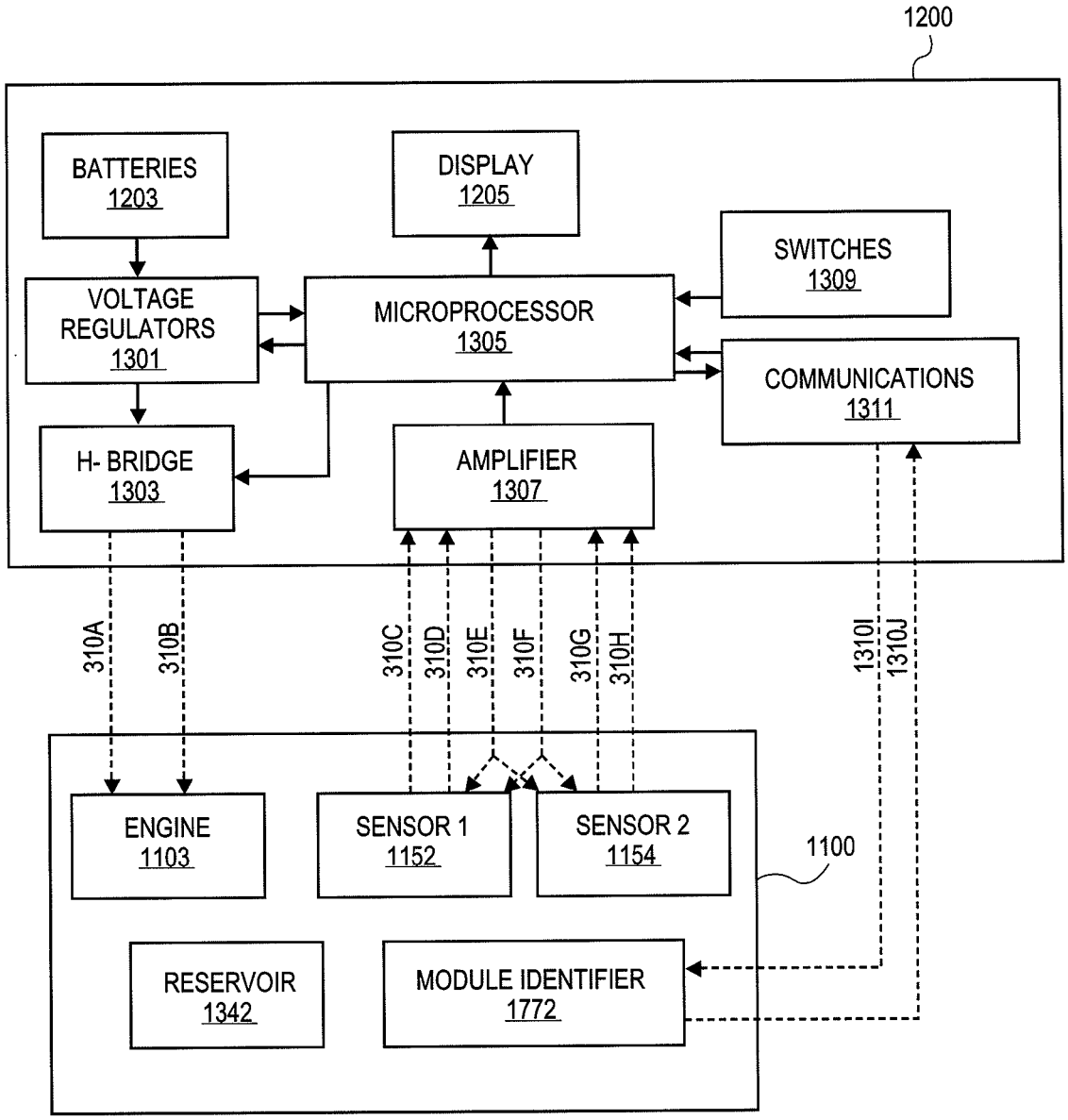
FIG. 11 is a schematic diagram of the electrical connections between components of an EK pump module and a control module including connections between a module identifier and the control module.

Further, referring to FIG. 11, the pump module 1100 can include a module identifier 1772. The module identifier 1772 can be, for example, a separate microprocessor, a set of resistors, an RFID tag, a ROM, a NandFlash, or a battery static RAM. The module identifier 1772 can store information regarding, for example, the type of delivery fluid in the pump module, the total amount of delivery fluid in the pump module, the pump module's configured range of flow rates, patient information, calibration factors for the pump, the required operation voltage for the pump, prescription, bolus rate, basal rate, bolus volume, or bolus interval. The information stored in the module identifier 1772 can be programmed into the module identifier by the manufacturer, the fluid manufacturer, such as a pharmaceutical company, and/or the pharmacist.

Like the module identifier 1772, the microprocessor 1305, can store information regarding the type of delivery fluid in the pump module, the total amount of delivery fluid in the pump module, the pump module's configured range of flow rates, patient information, calibration factors for the pump, the required operation voltage for the pump, prescription, bolus rate, basal rate, bolus volume, or bolus interval. The information stored in the microprocessor can be programmed into the module identifier by the person delivering the fluid to the patient.

The module identifier and the microprocessor 1305 can be configured to communicate communication signals 1310*i*, 1310*j*. The signals 1310*i*, 1310*j* can be used to ensure that the pump module 1100 runs properly (e.g., runs with the correct programmed cycles). Despite the additional sensors in this embodiment, a simple mechanical and electrical connection can still be made between the pump module 1100 and the control module 1200, such as using a DB9, molex, card edge, circular, contact, mini sub-d, usb, or micro usb.

In some embodiments, the microprocessor 1305 includes the majority of the programmed information, and the module identifier 1772 includes only the minimum amount of information required to identify the pump, such as the type and amount of drug in the particular pump as well as the required voltage levels. In this instance, the microprocessor 1305 can detect the required delivery program to run the pump module 1100 properly. In other embodiments, the module identifier 1772 includes the majority of the programmed information, and the microprocessor 1305 includes only the minimum amount of information required to properly run the pump. In this instance, the control module 1200 is essentially instructed by the module identifier 1772 regarding the required delivery program. In still another embodiment, each of the microprocessor 1305 and the module identifier 1772 include some or all of the required information and can coordinate to run the pump properly.

The information stored in the module identifier 1772 and microprocessor 1305 can further be used to prevent the pump module from delivering the wrong fluid to a patient. For example, if both the pump module 1772 and the microprocessor 1305 were programmed with patient information or prescription information, and the two sets of information did not match, then the microprocessor 1305 can be configured to prohibit the pump module from delivering fluid. In such instances, an audible or visible alarm may be triggered to alert the user that the pump system has been configured improperly. Such a "handshake" feature advantageously provides an increased safety check on the delivery system.

Although the gel coupling is described herein as being used with an electrokinetic pump system, it could be used in a variety of pumping systems, including hydraulic pumps, osmotic pumps, or pneumatic pumps. Moreover, in some embodiments, a gel as described herein could be used in addition to a piston, i.e. between the piston and the membrane, to provide enhanced efficiency by allowing there to be less unsupported area of the membrane due to the compressibility of the gel, as described above.

Further, the modularity aspects of the systems described herein, such as having a separate pump module and control module need not be limited to EK systems nor to systems having a gel coupling. Rather, the modularity aspects could be applicable to a variety of pumping systems and/or to a variety of movable members, such as a mechanical piston, separating the engine from the pump.

As for additional details pertinent to the present invention, materials and manufacturing techniques may be employed as within the level of those with skill in the relevant art. The same may hold true with respect to method-based aspects of the invention in terms of additional acts commonly or logically employed. Also, it is contemplated that any optional feature of the inventive variations described may be set forth and claimed independently, or in combination with any one or more of the features described herein. Likewise, reference to a singular item, includes the possibility that there are plural of the same items present. More specifically, as used herein and in the appended claims, the singular forms "a," "and," "said," and "the" include plural referents unless the context clearly dictates otherwise. It is further noted that the claims may be drafted to exclude any optional element. As such, this statement is intended to serve as antecedent basis for use of such exclusive terminology as "solely," "only" and the like in connection with the recitation of claim elements, or use of a "negative" limitation. Unless defined otherwise herein, all technical and scientific terms used herein have the same meaning as commonly understood by one of ordinary skill in the art to which this invention belongs. The breadth of the present invention is not to be limited by the subject specification, but rather only by the plain meaning of the claim terms employed.

It is intended that the following claims define the scope of the invention and that methods and structures within the scope of these claims and their equivalents be covered thereby.

What is claimed is:

1. A fluid delivery system, comprising:

a pump module having a pumping chamber therein;

a pump engine configured to generate power to pump delivery fluid from the pumping chamber; and a flexible member comprising a first and second diaphragms fluidically separating the pump module from the pump engine and configured to deflect into the pumping chamber when pressure is applied to the flexible member from the pump engine, wherein the flexible member comprises a gel occupying 50%-95% of an area between deflectable portions of the first and second diaphragms so as to transfer more than 80% of an amount of power generated by the pump engine to the pump module to pump delivery fluid from the pumping chamber.

2. The fluid delivery system of claim 1, wherein the pump engine is an electrokinetic engine.

3. A fluid delivery system, comprising:

a first chamber, a second chamber, and a third chamber;

a pair of electrodes between the first chamber and the second chamber;

a porous dielectric material between the electrodes;

an electrokinetic fluid configured to flow through the porous dielectric material between the first and second chambers when a voltage is applied across the pair of electrodes; and a flexible member comprising a gel between two diaphragms, the flexible member fluidically separating the second chamber from the third chamber, wherein the diaphragms and the gel deform into the third chamber and conform to an interior shape of the third chamber when the electrokinetic fluid flows from the first chamber into the second chamber.

4. The fluid delivery system of claim 3, wherein there is a void occupying 5%-50% of a space between a deformable portion of the first and second diaphragms.

5. The fluid delivery system of claim 3, wherein the gel material is adhered to the first and second diaphragms.

6. The fluid delivery system of claim 3, wherein the gel material is separable from the first or second diaphragms when a leak forms in the first or second diaphragms.

7. The fluid delivery system of claim 3, wherein the gel material comprises silicone, acrylic PSA, silicone PSA, or polyurethane.

8. The fluid delivery system of claim 3, wherein the diaphragm material comprises a thin-film polymer.

9. The fluid delivery system of claim 3, wherein a ratio of a diameter of the third chamber to a height of the third chamber is greater than 5/1.

10. The fluid delivery system of claim 3, wherein a thickness of the gel in a neutral pumping position is greater than a height of the third chamber.

11. The fluid delivery system of claim 3, wherein the flexible member is configured to pump a delivery fluid from the third chamber when the voltage is applied across the first and second electrodes.

12. The fluid delivery system of claim 3, wherein the flexible member is configured to stop deforming when the electrokinetic fluid stops flowing between the first and second chambers.

13. The fluid delivery system of claim 3, wherein the gel is configured to compress between the first and second diaphragms when the flexible member pumps fluid from the third chamber.

14. A method of pumping fluid comprising:

applying a first voltage to an electrokinetic engine to deflect a flexible member in a first direction to draw a set volume of fluid into a pumping chamber of an electrokinetic pump, the flexible member comprising a gel between two diaphragms; and applying a second voltage opposite to the first voltage to the electrokinetic engine to deflect the flexible member into the pumping chamber to pump the fluid out of the pumping chamber; and stopping the application of the second voltage to stop the deflection of the flexible member into the pumping chamber mid-stroke so as to deliver less than the set volume of fluid out of the pumping chamber.

15. The method of claim 14, wherein stopping the application of the second voltage comprises stopping the pumping of fluid out of the pumping chamber with stopping the application of the second voltage.

16. The method of claim 14, further comprising compressing the gel between the first and second diaphragms when the flexible member is deflected into the pumping chamber.

17. The method of claim 14, further comprising applying the second voltage until the flexible member substantially conforms to an interior surface of the pumping chamber.

* * * * *